US007585268B2

(12) United States Patent
Cheich et al.

(10) Patent No.: US 7,585,268 B2
(45) Date of Patent: Sep. 8, 2009

(54) MOTOR FREE DUNNAGE CONVERTING SYSTEM

(75) Inventors: Robert C. Cheich, Independence, OH (US); Hubertus Y. Cals, Maastricht (NL); Erwin Riga, Sittard (NL); Donald Gorg, Mentor, OH (US); Daniel L. Carlson, Ravenna, OH (US); Shawn M. Baiers, Sheffield Lake, OH (US); Edward S. Martis, Jr., Kirtland, OH (US); Carrie A. Schlegel, Ashtabula, OH (US)

(73) Assignee: Ranpak Corp., Concord Township, OH (US)

( * ) Notice: Subject to any disclaimer, the term of this patent is extended or adjusted under 35 U.S.C. 154(b) by 0 days.

(21) Appl. No.: 11/577,949

(22) PCT Filed: Oct. 25, 2005

(86) PCT No.: PCT/US2005/038811

§ 371 (c)(1),
(2), (4) Date: Nov. 28, 2007

(87) PCT Pub. No.: WO2006/047696

PCT Pub. Date: May 4, 2006

(65) Prior Publication Data

US 2008/0125300 A1 May 29, 2008

Related U.S. Application Data

(60) Provisional application No. 60/667,752, filed on Apr. 1, 2005, provisional application No. 60/655,093, filed on Feb. 22, 2005, provisional application No. 60/624,695, filed on Nov. 3, 2004, provisional application No. 60/621,829, filed on Oct. 25, 2004.

(51) Int. Cl.
*B31B 1/00* (2006.01)

(52) U.S. Cl. ..... 493/464; 493/967; 206/233; 206/395; 206/408; 206/494

(58) Field of Classification Search ..... 493/464, 493/967; 206/233, 395, 396, 408, 409, 494
See application file for complete search history.

(56) References Cited

U.S. PATENT DOCUMENTS

| | | | | |
|---|---|---|---|---|
| 2,806,591 | A * | 9/1957 | Appleton | 225/106 |
| 3,509,797 | A * | 5/1970 | Johnson | 493/340 |
| 5,131,903 | A | 7/1992 | Levine et al. | |
| 5,215,211 | A * | 6/1993 | Eberle | 221/1 |

(Continued)

FOREIGN PATENT DOCUMENTS

| | | | |
|---|---|---|---|
| DE | 195 20 907 | A1 | 1/1996 |
| GB | 2 106 862 | A | 4/1983 |
| GB | 2 328 199 | A | 2/1999 |
| WO | 01/94107 | A | 12/2001 |

*Primary Examiner*—Hemant M Desai
(74) *Attorney, Agent, or Firm*—Renner, Otto, Boisselle & Sklar, LLP

(57) ABSTRACT

A motor-free dunnage conversion system comprises a housing (20) having a dispensing outlet (40) through which sheet stock material (34) can be pulled by a user to form a strip of dunnage. The housing (20) has a forming member (44, 50) with circumferentially converging side walls that gradually inwardly gather and crumple the sheet stock material as it is pulled therethrough. The system can also include one or more of a stand having a support mounted thereto for supporting a supply of stock material, a repositionable member (22) supporting the forming member (44, 50), a guide member at the upstream end of the housing to guide the stock material from a supply to the forming member, and a catch device operative upon movement of the dunnage strip relative thereto to catch and hold the strip for severing a dunnage product therefrom.

8 Claims, 20 Drawing Sheets

U.S. PATENT DOCUMENTS 5,335,811 A * 8/1994 Morand ..... 221/45
5,481,817 A * 1/1996 Parker ..... 248/286.1
5,819,720 A * 10/1998 Schubert ..... 126/41 R
6,217,498 B1 4/2001 Simmons
6,276,087 B1 * 8/2001 Singletary ..... 42/94
6,676,589 B2 1/2004 Kung et al.
7,025,301 B1 * 4/2006 Notarnicola ..... 242/593
7,407,471 B2 * 8/2008 Demers et al. ..... 493/464
2003/0216236 A1 11/2003 Harding et al.
2005/0181924 A1 8/2005 Demers et al.
2005/0215408 A1 * 9/2005 Yampolsky et al. ..... 493/464
2007/0117703 A1 * 5/2007 Cavaliere et al. ..... 493/464

* cited by examiner

MOTOR FREE DUNNAGE CONVERTING SYSTEM

This invention claims the benefit of International Patent Application No. PCT/US2005/038811, filed Oct. 25, 2005, published in English as International Publication No. WO/2006/047696, which claims the benefit of U.S. Provisional Application Nos. 60/692,865, filed Jun. 21, 2005; 60/655,093, filed Feb. 22, 2005; 60/624,695, filed Nov. 3, 2004; 60/621,829, filed Oct. 25, 2004; and 60/667,752, filed Apr. 1, 2005 all of which are hereby incorporated herein by reference.

FIELD OF THE INVENTION

The present invention relates generally to a dunnage converting system and method for converting a sheet stock material into a dunnage product, and more particularly to such a system and method that does not require a motor.

BACKGROUND

In the process of shipping one or more articles, products or other articles in a container, such as a cardboard box, from one location to another, a packer typically places some type of dunnage material in the shipping container along with the article or articles to be shipped. The dunnage material partially or completely fills the empty space or void around the one or more articles in the container to prevent or minimize any shifting of the articles in the container and/or to provide cushioning for the articles in the container during the shipping process. Some commonly used dunnage materials are plastic foam peanuts, plastic bubble pack, air bags and converted paper dunnage material.

To use storage space more efficiently, a dunnage conversion machine can be used to convert a compact supply of stock material, such as a roll or stack of paper, into a lower density dunnage material as the dunnage material is needed by the packer. These dunnage-on-demand conversion machines typically include one or more motors for driving a conversion assembly and/or a cutting assembly. For example, U.S. Pat. No. 6,676,589 discloses an exemplary dunnage conversion machine that can quickly convert a continuous sheet of paper into a crumpled strip of void-fill dunnage material.

These powered dunnage converters are well suited for high or medium volume applications. They also can be used for low volume applications where a small amount of dunnage is needed from time-to-time, but usually the cost is too high. The powered converters also are somewhat bulky and occasionally require maintenance or repair. Consequently, low volume applications have been serviced by other types of dunnage, such as plastic foam peanuts and manually crumpled newspaper. Plastic foam peanuts are messy and occupy the same volume when being stored as when being used. Crumpled newspaper also is messy and requires the packer to manually crumple the newspaper.

Another apparatus for crumpling and dispensing dunnage is shown in U.S. Pat. No. 5,131,903. This apparatus includes a box-like housing holding a frame. The frame has a pair of inclined side walls for guiding sheet paper from a roll of paper through a reduced dimension corrugated-shaped opening that is generally aligned with an opening in the housing. A problem with such an apparatus is that the reduced width opening is in a frame member that forms a transversely extending shelf surrounding the opening. The paper can catch on this shelf as the paper is being pulled through the opening and can potentially cause undesirable tearing of the paper. Another perceived disadvantage is that portions of the crumpled paper cannot be efficiently and effectively separated in an easy manner. Still another disadvantage is replacement of the roll of paper is a relatively involved task, requiring disassembly of the housing and inner frame. Yet another drawback is the relatively large bulky size of the apparatus when compared to the supply of paper contained therein—that is, the apparatus contains a substantial amount of empty space within the box-like housing.

SUMMARY

The present invention provides a dunnage system and method that do not require a motor for converting a sheet stock material into a dunnage product. Instead, the sheet stock material is pulled from a converter by a packer as dunnage is needed. As the stock material is pulled from the converter, it is converted from in essence a two-dimensional sheet into a relatively less dense crumpled three-dimensional dunnage product.

An exemplary embodiment of the motor-free converter is lightweight, compact, portable, easy to use, and is essentially maintenance free. A particularly advantageous converter according to the invention has no parts that move during the conversion process; only the sheet stock material moves. The dunnage converter is particularly useful with a fan-folded stock material that has longitudinally spaced-apart transverse rows of perforations for separating the converted dunnage into discrete sections, as by tearing, along a row of the perforations.

More particularly, the present invention provides a motor-free dunnage system that includes a forming member having a converging side wall or walls that terminate at a reduced-size outlet through which a user can draw sheet stock material and thereby crumple the sheet stock material as it is drawn therethrough to form a relatively less dense strip of dunnage. Preferably the system is without moving parts.

A method provided in accordance with the present invention includes the step of manually pulling a sheet stock material from a supply of sheet stock material and through a circumferentially converging forming member, whereby the stock material is crumpled and permanently deformed to form a relatively less dense strip of dunnage.

Another aspect of the invention provides a motor-free dunnage system that includes a supply of fan-folded sheet stock material and means for inwardly gathering and crumpling sheet stock material manually pulled therethrough.

According to another aspect of the invention, a dunnage system includes a container and a fan-fold sheet stock material contained in the container. The container has an opening in a wall of the container through which a user can draw sheet stock material and thereby crumple the sheet stock material to form a relatively less dense strip of dunnage. A forming member is mountable to the container, and has a passage therethrough that can be aligned with the opening in the container. The passage in the forming member is defined by converging side walls, and additionally or alternatively the wall having the opening therein is movable between a shipping position and a converting position removed from the shipping position.

According to another aspect of the invention, a dunnage system a container with a forming member having converging sidewalls terminating in a reduced-width outlet opening. The container can have an opening in a wall thereof through which a sheet stock material can be withdrawn by a user, thereby forming a relatively less dense strip of dunnage. The wall of the container can be movable between a shipping position and a converting position removed from the shipping position.

The forming member can be a converging chute that has a flange that extends generally perpendicular to an axis of the passage through the chute. Additional or alternatively, the forming member can extend over a top side of a container.

The present invention also provides a method comprising the steps of attaching a forming member to a container, and manually pulling the sheet stock material through the forming member, thereby crumpling and permanently deforming the sheet stock material to form a relatively less dense strip of dunnage.

In accordance with another aspect of the invention, a dunnage system includes a container sized to receive a supply of sheet stock material within the container. The container has a dispensing outlet for a user to draw sheet stock material therethrough to form a relatively less dense strip of dunnage. The dispensing outlet is movable between a shipping position and a converting position removed from the shipping position. The container can be configured to include features that can be used to limit the extent to which the wall can move from the converting position as the sheet stock material is pulled through the opening.

A method provided by the present invention includes the steps of moving a dispensing outlet from a shipping position to a converting position removed from the shipping position, and pulling a sheet stock material from a supply of sheet stock material and through dispensing outlet when the dispensing outlet is in the converting position for crumpling and permanently deforming the sheet stock material to form a relatively less dense strip of dunnage.

According to another aspect of the invention, a motor-free dunnage system includes forming member through which a sheet stock material can be drawn to crumple the sheet stock material and thereby form a relatively less dense strip of dunnage, and a stand to which the forming member is mounted.

According to another aspect of the invention, a motor-free dunnage system and a transversely extending guide upstream of the forming member to provide a substantially constant path for the stock material from the transversely extending guide to the forming member as sheet stock material is drawn from the supply.

In accordance with another aspect of the invention, a motor-free dunnage system includes a dispensing outlet through which a relatively less dense strip of dunnage can be pulled by a user, and a catch device downstream of the dispensing outlet for catching the strip of dunnage so that a section of dunnage can be separated from the strip.

According to another aspect of the invention, a dunnage system for converting sheet stock material into a relatively less dense dunnage product, includes a dispensing outlet which is bounded by a flexible sheet. Preferably the flexible sheet spans an opening in a wall, and is free to flex out of the plane of the wall when sheet stock material is passing therethrough.

According to another aspect of the invention, a dunnage system includes a container, a supply of sheet stock material in the container, a forming member housed in the container with the supply of sheet stock material, and means for attaching the forming member at an opening in a wall of the container so that the stock material can be pulled therethrough and converted into a dunnage product.

And in accordance with another aspect of the invention, a motor-free dunnage system includes a base, a dispensing outlet through which a user can draw sheet stock material to form a relatively less dense crumpled strip of dunnage, and a frame member for adaptably mounting the dispensing outlet to the base.

A motor-free dunnage system according to another aspect of the invention includes a forming member removably attached to an open side of a container for a supply of sheet stock material and through which a user can draw sheet stock material and thereby crumple the sheet stock material as it is drawn through the forming member to form a relatively less dense strip of dunnage.

The foregoing and other features of the invention are shown in the drawings and particularly pointed out in the claims. The following description and annexed drawings set forth in detail several illustrative embodiments of the invention; this being indicative, however, of but a few of the various ways in which the principles of the invention might be employed.

DETAILED DESCRIPTION

Figure 1:
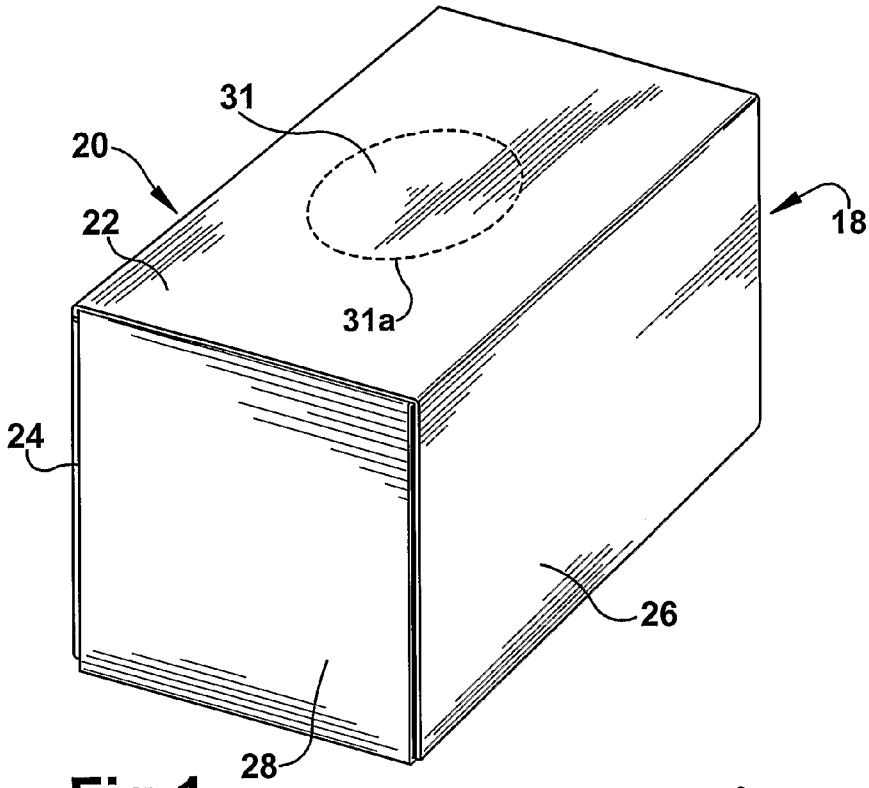
FIG. 1 is a perspective view of one embodiment of a dunnage system in accordance with the present invention in a shipping configuration.
Figure 2:
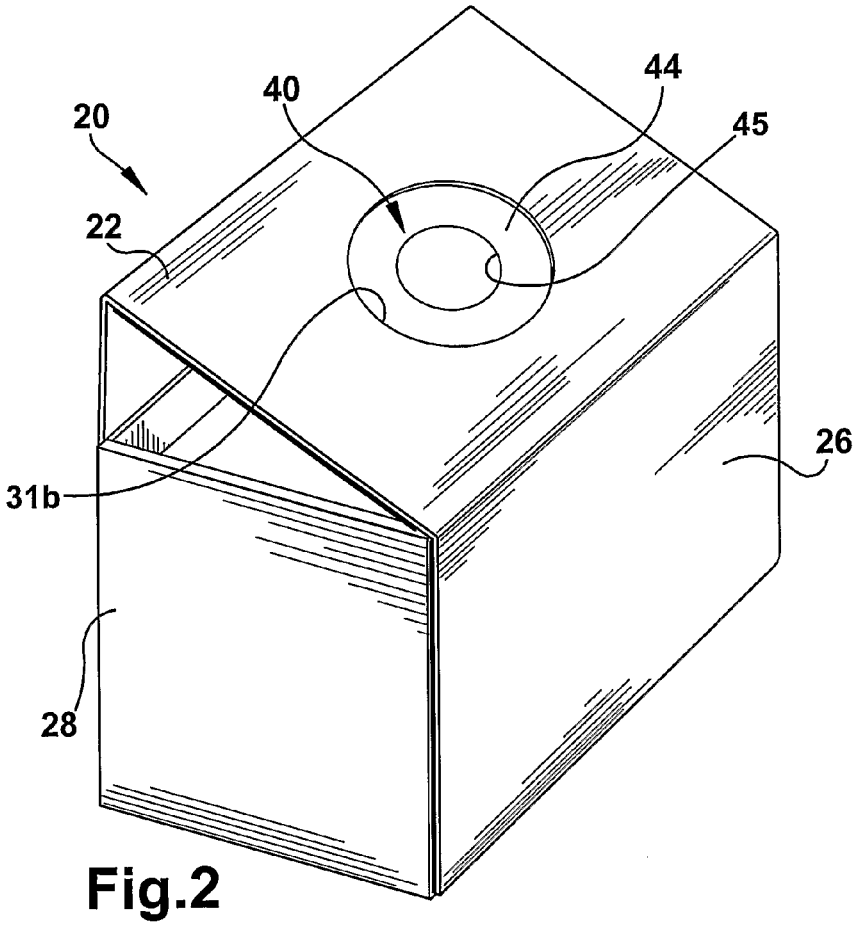
FIG. 2 is a perspective view of the dunnage system of FIG. 1 in a converting configuration.
Figure 3:
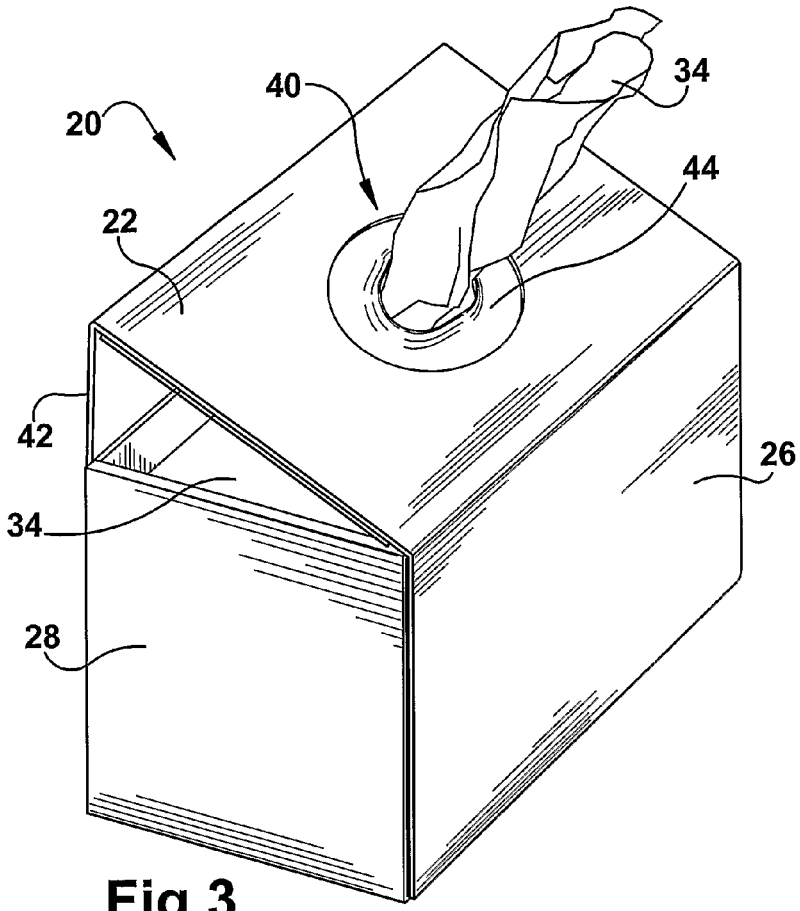
FIG. 3 is a perspective view similar to FIG. 2 with a dunnage product extending therefrom.

The present invention provides a motor-free dunnage system and method for converting a sheet stock material, such as a continuous sheet of paper, into a relatively less dense dunnage product without the need for a motor. Instead, the sheet material is pulled through a forming member by a packer to form a strip dunnage as it is needed. As the sheet material is pulled through the forming member, it is converted from in essence a two-dimensional sheet into a relatively less dense three-dimensional crumpled dunnage product.

An exemplary dunnage system includes a housing in the form of a container for a supply of sheet stock material. One wall of the container has an opening through which the sheet stock material is pulled by a packer. The stock material, which is wider than the opening, is inwardly gathered, randomly crumpled and permanently deformed to form a relatively less dense strip of dunnage. The opening thus acts as a forming member. Due to its converting function, the forming member can also be referred to as a conversion device. The system provides a convenient way to convert sheet stock material, such as fan-fold paper, into a relatively lower density dunnage product as it is needed.

In an exemplary embodiment, the container is reconfigurable from a compact shipping configuration to a less compact converting configuration by moving the wall of the container having the opening therethrough from a shipping position to a converting position displaced from the shipping position and generally further from the supply of stock material within the container. Reconfiguring the container to increase the distance between the opening in the wall and the stock material improves the process of shaping and crumpling the stock material to form the dunnage product, while maximizing the efficient use of the shipping and storage space.

The system can additionally or alternatively include a forming member with a circumferentially converging surface. The circumferentially converging surface defines a passage having a smaller outlet than inlet. The circumferentially converging surface provides a smooth transition from the inlet to the outlet. The forming member can be mounted to the container and cooperate with the opening therein to inwardly gather and crumple the stock material as the packer pulls the stock material out of the container and through the forming member. Alternatively, the forming member can be supported by a stand rather than a container.

Referring now to the drawings, and initially to FIGS. 1-5, an exemplary dunnage system according to the invention is indicated generally by reference numeral 18. The dunnage system 18 comprises a container 20 that typically has, when in a closed configuration for shipping and/or storage, a generally rectangular shape. The container may be made of any suitable, preferably disposable or recyclable, material such as one or more of cardboard, corrugated or solid fiberboard, paperboard or plastic. The container 20 could include more or fewer walls of various orientations for storing and transporting the supply of stock material.

When assembled and closed as shown in FIG. 1, the container 20 has a top wall 22, a bottom wall (not shown) spaced from the top wall, and four upright side walls. The side walls include a front wall 24, a back wall 26, and a pair of end walls 28 and 30. As shown, the top wall 22 may be provided with a cutout or knockout portion 31 that can be removed to form or expose a dunnage dispensing outlet 40 (FIG. 2) through which stock material can be withdrawn from the container in the hereinafter described manner. The portion can be delineated by a cut line whereby a user can cut along the cut line and form or expose the dispensing outlet 40 in the top of the container. More preferably, the knockout portion can be delineated by a line of perforations or score line 31*a* forming a frangible connection between the knockout portion and the balance of the top wall. When the cutout or knockout is removed, an opening 31*b* is formed in the top wall of the container. If desired, the opening 31*b* can be originally provided, and optionally covered by a protective sheet that may be removed to expose the dispensing outlet 40.

The container 20 is sized to contain a supply 32 of sheet stock material 34 therein. The supply 32 includes one or more plies of sheet stock material 34, such as paper, and more particularly kraft paper. The stock material 34 can be provided in the form of a fan-folded stack, as shown, in the form of a roll, or in the form of a stack of discrete sheets. The fan-folded stack (or stacks) can rest on the bottom wall of the box and substantially fill the correspondingly rectangular container. If discrete sheets are used, the discrete sheets preferably are interleaved and of sufficient length such that pulling a leading sheet off the stack will draw a trailing sheet with it, one after the other. If one or more stock rolls are used, the stock roll or rolls can be supported in the container by suitable means for rotation so that the stock material can be paid off from the outside of the roll. In an alternative arrangement, the stock roll or rolls can be supported on one or more outer portions of the roll so that stock material can be withdrawn from the center or inside of the roll. In this alternative arrangement, the stock material generally will be drawn out of an opening in an end wall of the container adjacent the end of the roll from which the stock material is being drawn. Regardless of the type of stock supply, preferably the stock material 34 is perforated or otherwise weakened along longitudinally-spaced, transversely-extending tear lines to enable and/or facilitate separating discrete sections of dunnage from the dunnage strip formed as the stock material is pulled from the dispensing outlet 40.

The dispensing outlet 40 of the container has a width dimension less than the width of the sheet stock material whereby the stock material will be gathered inwardly and crumpled as the sheet stock material is drawn from the stock material supply and through the dispensing outlet. The dispensing outlet may be formed by an opening (hole) in the top wall of the container, such as the opening 31*b* formed when the cutout or knockout portion 31 is removed. The opening in the wall can function as a forming member to inwardly gather and crumple the sheet stock material as it is drawn from the supply of stock material and through the opening to form a dunnage product. The opening may have a rounded shape, such as a circular or elliptical shape, although other shapes also could be effective for gathering and crumpling the stock material as it is pulled through the opening. The top wall of the container may also be provided with a slot (not shown) that is substantially the same width or wider than the sheet stock material to allow sheet stock material to be withdrawn from the supply without crumpling. This can be useful when wrapping relatively flat articles or providing a cover layer or a base layer in a packing container in which an article is to be packed. As another alternative, the above opening or openings can be provided in a side wall of the container, that is, in a wall adjacent the folded edges of the fan-folded stock material. Such an opening would normally be provided above the height of the stack of fan-folded stock material or other stock material contained in the container.

Figure 4:
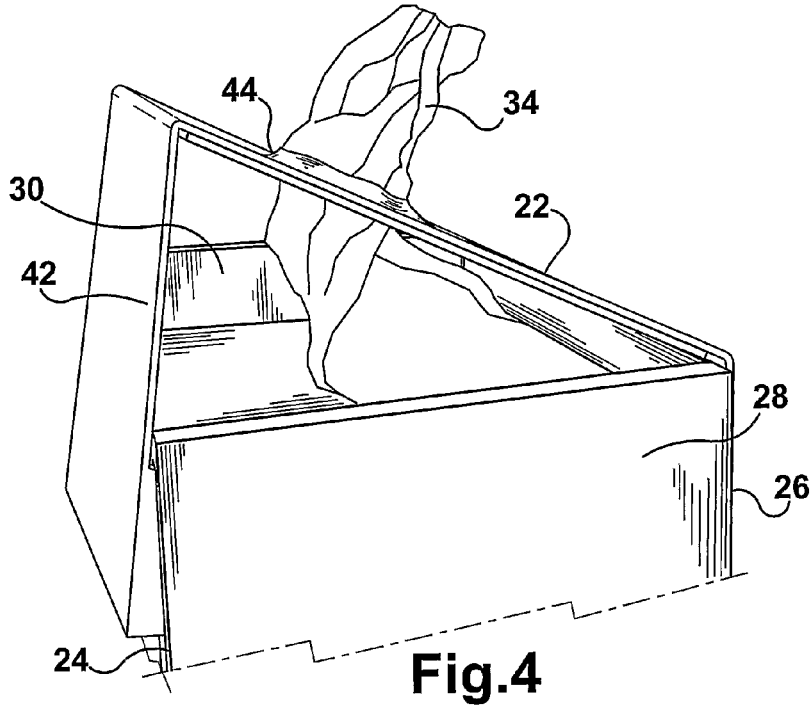
FIG. 4 is partial perspective view of the dunnage system of FIG. 2.
Figure 5:
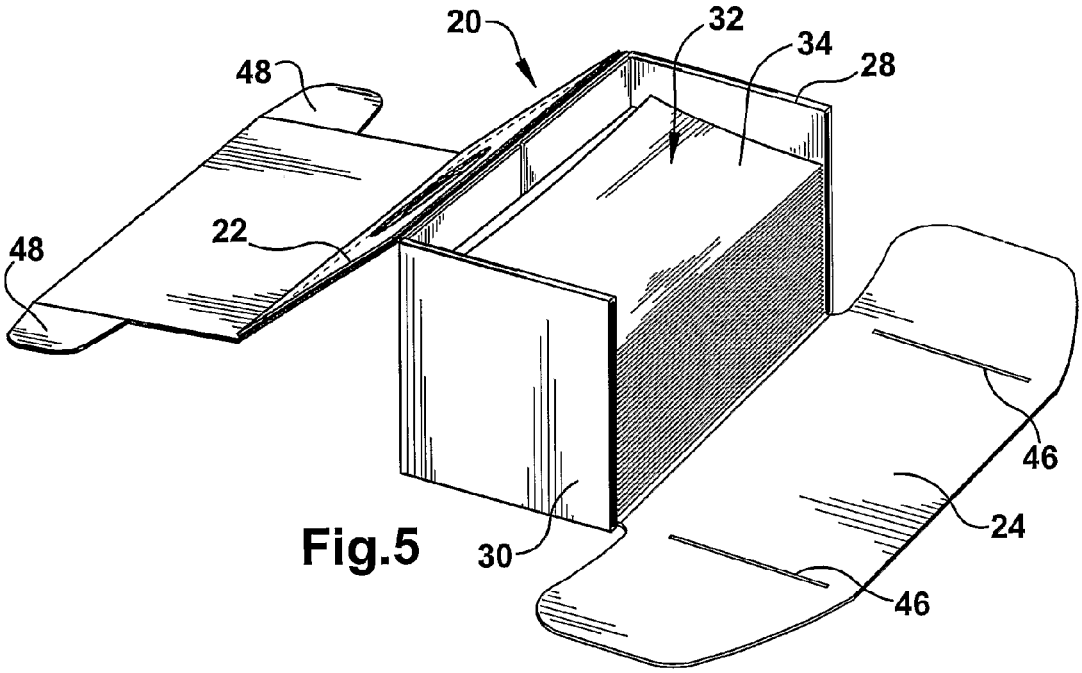
FIG. 5 is a perspective view of the dunnage system of FIG. 1, partially opened to show a supply of sheet stock material contained therein.

While the dispensing outlet 40 can be formed by an opening in a wall of the container, more preferably the dispensing outlet is located at and/or formed by the end of a forming member 44 located at the opening in the container wall. In the dunnage system shown in FIGS. 1-5, the forming member 44 is a sheet of material affixed, for example by a suitable adhesive, at marginal edge portions thereof to the container wall and includes an opening 45 that defines the dispensing outlet 40 through which the sheet stock material is withdrawn. Preferably the sheet is made of plastic and preferably a flexible plastic that is free to flex out of the plane of the container wall as sheet stock material is pulled therethrough. The flexible plastic has a smooth interior surface over which the sheet stock material can flow relatively freely and this will reduce the likelihood of the stock material inadvertently catching and tearing as might otherwise occur if the opening where formed directly by the relatively more rigid material from which the container is formed, such as cardboard. Additionally, the outward flexing of the flexible sheet, i.e., forming member, to assume a funnel shape with the inner wall surface or surfaces thereof circumferentially converging inwardly provides a smooth transition from a relatively large entry opening or aperture to a smaller exit opening or aperture as best seen in FIG. 4. That is, the flexible sheet will be transformed into a converging forming member that progressively narrows in cross-section going from an entry opening or aperture to a smaller exit opening or aperture.

Figure 6:
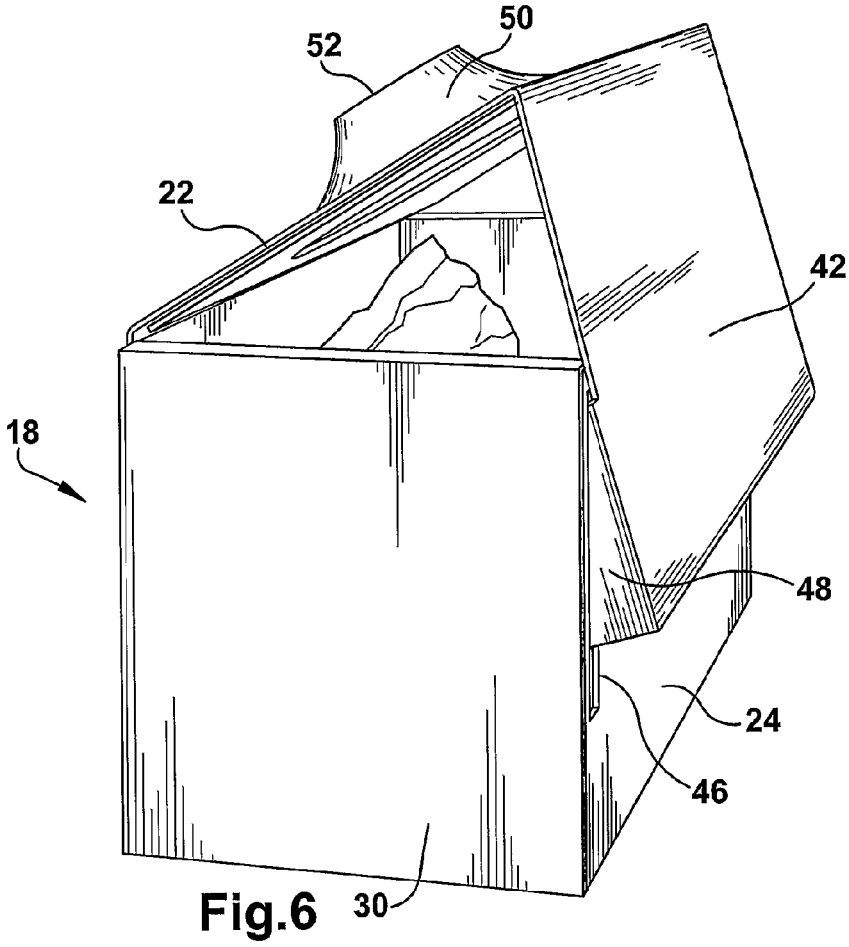
FIG. 6 is a perspective view of the dunnage system of FIG. 1, but provided with a different forming member through which stock material is drawn to form a dunnage product.
Figure 8:
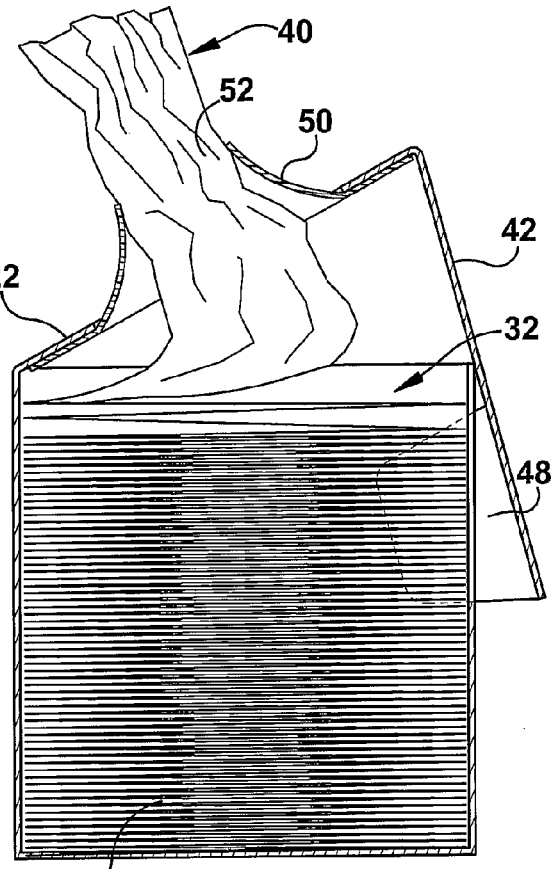
FIG. 8 is a cross-sectional view of the modified dunnage system of FIG. 6 as seen along lines 8-8 of FIG. 7.
Figure 7:
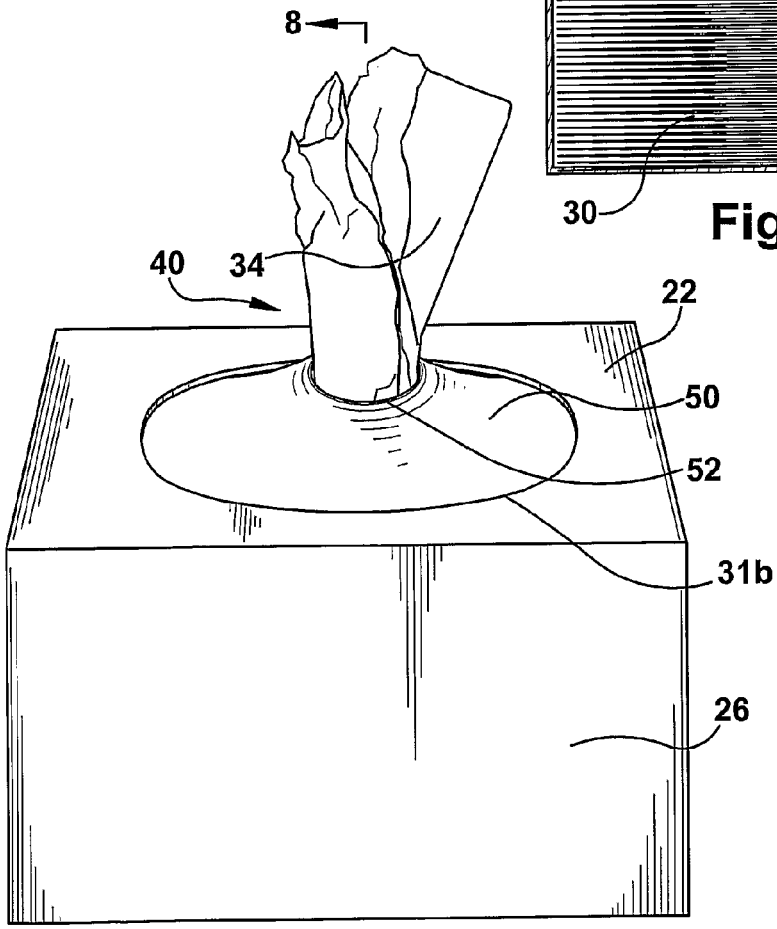
FIG. 7 is a top and front perspective view of the modified dunnage system of FIG. 6 with a dunnage product being dispensed therefrom.

In FIGS. 6-8, the dunnage system 18 is shown with a different form of forming member, indicated at 50. The forming member 50 is made of a relatively rigid material that preferably has a smooth interior surface over which the sheet stock material can flow relatively freely. The forming member 50 may be in the form of a funnel or chute as shown. This forming member 50 guides and shapes the stock material in a circumferentially converging manner to inwardly gather and randomly crumple the stock material as it is drawn therethrough. The illustrated forming member 50 has a converging side wall or walls that define a passage therethrough and terminate in a reduced-width outlet opening 52 spaced from a wider inlet opening located at the opening in the wall. Thus the forming member 50 functions as a funnel or converging chute and generally provides a gradual and relatively smooth transition from the relatively larger opening 40 in the wall to the relatively smaller outlet opening 52.

The forming member 50 is mounted to the top wall at the opening 31*b*. To this end, the forming member may have a peripheral mounting flange affixed to the top wall (or other wall containing the opening 31*b*). Preferably the mounting flange is attached by an adhesive to the inside surface of the top wall generally centrally disposed in the top wall of the container. The transition between the mounting flange and the larger end of the converging portion of the forming member can be rounded for a smooth transition that reduces or avoids catching of the paper thereon. As will be appreciated, the forming member 50 can be stored in the container 20 between the top wall 22 and the supply 32 of stock material 34 when the dunnage system is in its closed configuration for storage and/or transport. When the container is opened for use of the dunnage system in the manner hereinafter described, the forming member 50 can be positioned in the opening with the funnel portion thereof protruding outwardly from the top wall of the container as shown FIGS. 6-8. To facilitate such attachment, the forming member may have on its mounting flange double-sided tape or other adhesive, and a release layer covering the adhesive. The release layer can be removed to expose the adhesive so that the mounting flange can be mounted to the top wall as described.

Those skilled in the art will also appreciate that other forming members could be used. By way of further example, a forming member made of metal or rigid plastic can be provided at the outlet opening thereof with a cutting and/or gripping device to facilitate separating discrete dunnage products from the crumpled dunnage strip. Such device could include a sharp knife edge for cutting the stock material, or a serrated blade having a plurality of teeth for catching and cutting the strip. As another alternative, the edge of the opening can include a notch for catching and either tearing the stock material or holding the stock material so that the packer can with one hand yank the dunnage strip in a transverse direction to tear a section of dunnage from the crumpled strip at a tear line in the stock material.

For shipping and/or storage, the dunnage system 18 will be in the closed configuration shown in FIG. 1. Because the preferred container 20 is substantially rectangular, multiple containers can be compactly stacked one atop the other and closely adjacent one another.

When the dunnage system 18 is to be used, the container is opened by outwardly moving the top wall of the container (or other wall containing the dispensing outlet) thereby to displace the dispensing outlet 40 and/or forming member further from the supply of sheet stock material contained in the container. Thus, the dunnage system includes a repositionable member supporting the forming member for conversion of the dunnage system from a compact shipping/storage configuration shown in FIG. 1 to a converting configuration shown in FIGS. 2 and 6-8 for converting the sheet stock material into a dunnage product. At least the wall with the discharge outlet 40 is movable between a shipping position and a converting position. The objective is to increase the distance between the forming member and the supply 32 of stock material 34 in the converting position, thereby to allow more room for gathering of the stock material as it passes from the stock supply to the forming member. In the illustrated embodiment, the top wall is hinged to the back wall for pivotal movement from a closed position (FIG. 1) to its operational converting position (FIGS. 2 and 6-8).

When the box is open, the cutout or knockout 31 (if provided) can be easily removed to expose the dispensing outlet, or alternatively a protective cover (if provided) can be removed. At this point a leading end of the sheet stock material can be fed through the forming member and dispensing outlet as seen in FIGS. 4 and 8. If desired, the bottom wall may be provided with adhesive that can be used to hold the container 20 to a surface so that it doesn't move as the stock material is withdrawn, particularly as the stock supply nears its end.

The wall with the dispensing outlet may be held in the converting position by a catch or other features that limit the extent to which the wall can move away from the supply of stock material as the sheet stock material is pulled through the opening. In the illustrated embodiment, the top wall is connected to one or more elements that cooperate with corresponding elements of the container to limit the extent to which the top wall can move as the sheet stock material is pulled through the opening.

In the illustrated embodiment the top wall 22 of the container is hingedly connected at is back edge to the back wall 26 of the container 20 and at is front edge to a flap wall 42. The flap wall 42 includes at least one, and preferably two tabs 48 at opposite sides thereof. The container 20 includes one or more slots 46 at or adjacent the junction of the front and respective end side walls for receiving the tabs when folded perpendicular to the flap wall. The slots 46 catch and hold the tabs 48 to limit the movement of the top wall 22 as stock material 34 is drawn through the opening 40. Friction typically is sufficient to keep the flaps from moving downward in the slots. An adhesive or other fastener can be used to hold the tabs in place, however.

When the dunnage system is in its closed configuration, the flap wall with its tabs may be stowed between the front wall and the supply of sheet stock material contained in the container. To allow for easy opening of the container, the front wall may be equipped with side flaps that fit in slots formed between inner and outer layers of double-walled ends of the container. To open the container, the front wall, which may be hinged at its bottom edge to the bottom wall, may be rotated outwardly to release the flap wall. The front wall may then be moved back to its original position with the flaps engaging in the slots formed in the double-walled ends of the container. The flap can then be lowered to insert the flap tabs in the slots in the front wall as above described, thereby reassembling the dunnage system in its conversion configuration.

The dunnage system is now ready for use. A packer can grab the crumpled dunnage strip protruding from the dispensing outlet and pull the strip from the container. As this is done, the sheet stock material will be pulled from the supply thereof and through the forming member and dispensing outlet, whereby the sheet stock material will be gathered and circumferentially progressively crumpled to form the dunnage strip that is being pulled from the container by the packer. When a desired amount of dunnage has been pulled from the container, the packer can tear, cut or otherwise separate a section of the dunnage strip for use in packing one or more articles in a shipping carton or the like.

Figure 10:
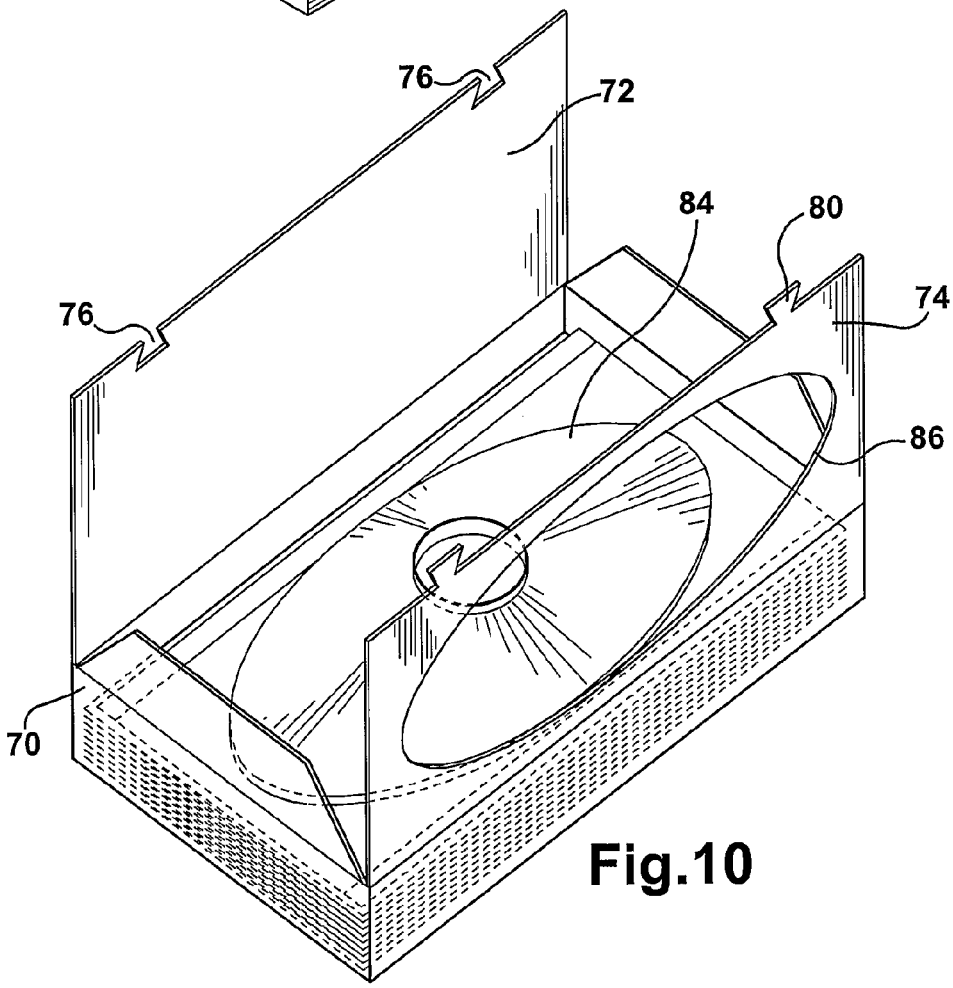
FIG. 10 is a perspective view of the dunnage system of FIG. 9 in an open configuration.
Figure 11:
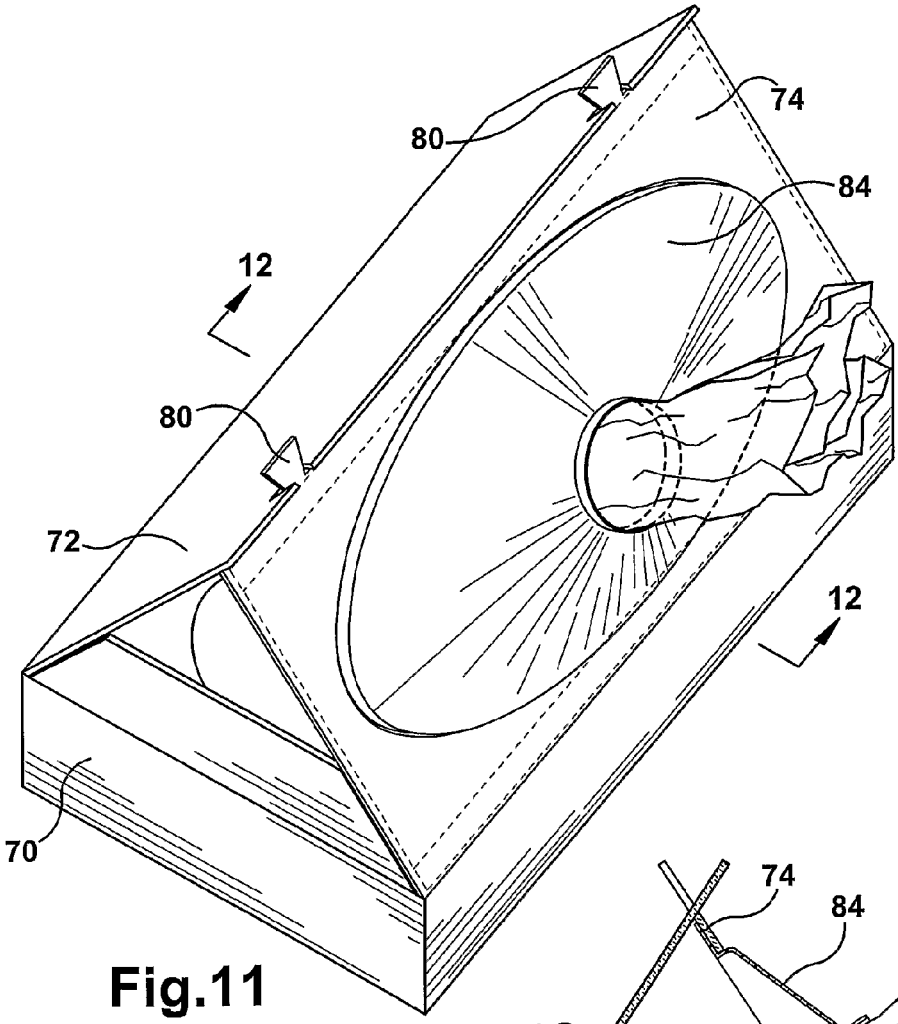
FIG. 11 is a perspective view of the dunnage system of FIG. 9 in a converting configuration.
Figure 12:
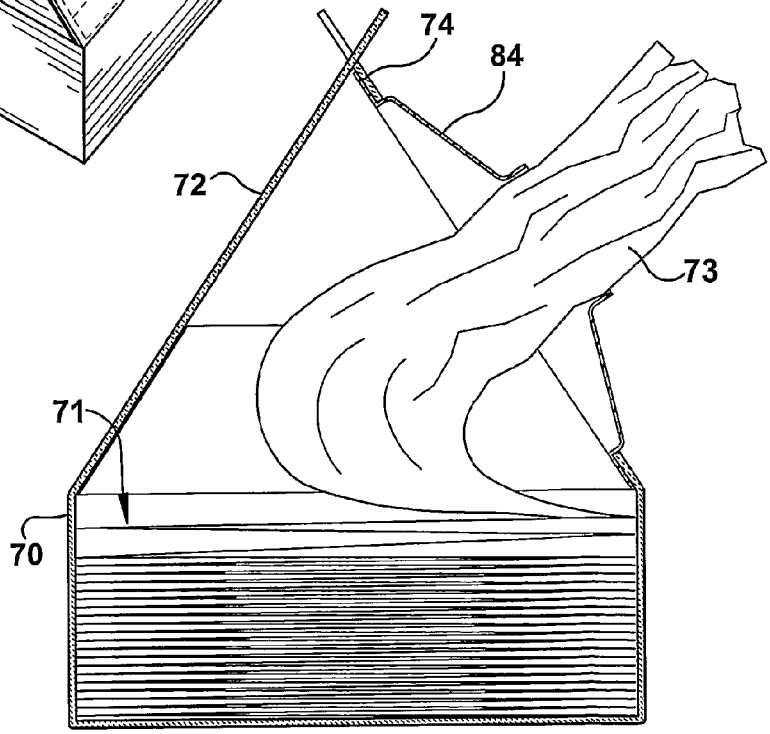
FIG. 12 is a cross-sectional view of the dunnage system of FIG. 11 as seen along lines 12-12.

Referring now to FIGS. 10-12, another dunnage system according to the invention is shown generally at 69. The dunnage system 69 includes a container 70 that contains a supply 71 of sheet stock material, such as fan-folded stock material 73. The container has overlapping top walls or flaps 72 and 74 that are respectively hinged to the top edges of front and back walls of the container. The top flap has along its free edge one or more slots, such as notches 76, and the other top flap has one or more corresponding tabs 80 along its free edge.

When the dunnage system is closed, the top flaps are folded one atop the other, thereby providing a compact, space-efficient configuration for shipping and/or storage. The container may also have side flaps for folding beneath the top flaps when the box is closed. In addition, one of the top flaps closes an opening in the other flap that receives a forming member as discussed below.

Figure 9:
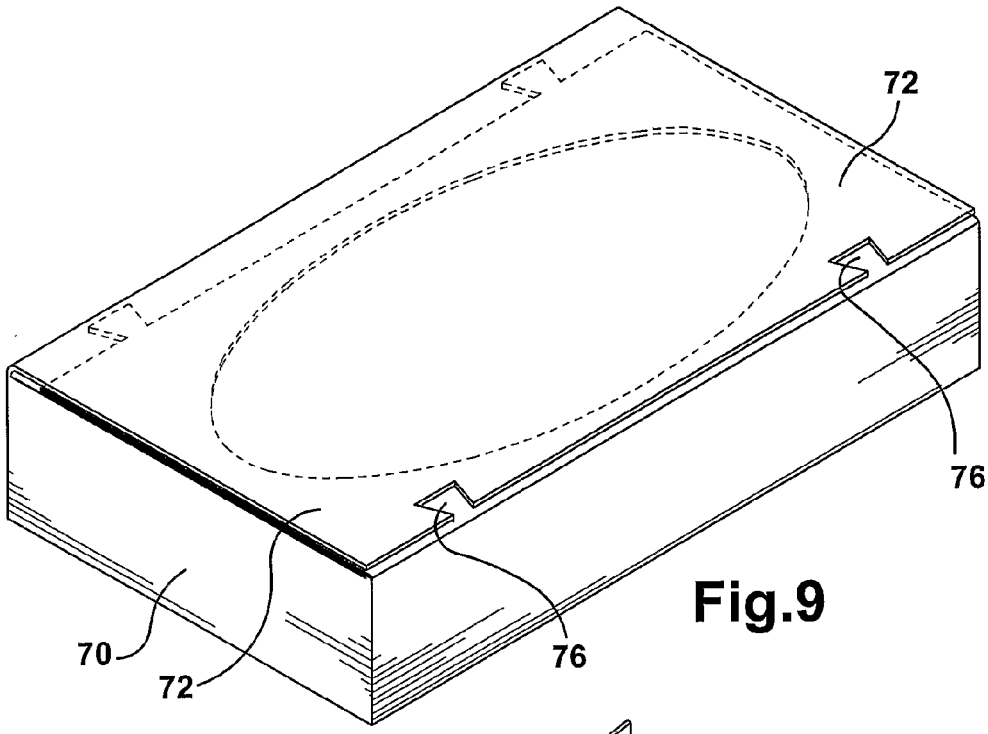
FIG. 9 is a perspective view of another dunnage system according to the present invention in a shipping configuration.

To use the dunnage system, the top flaps are rotated upwardly from relatively parallel positions (FIG. 9) to generally intersecting positions (FIGS. 11 and 12). The tabs 80 and notches 76 have cooperating shapes so that they can be engaged to hold the top flaps in their raised converting position. The side flaps may also be rotated upwardly to allow for passage of the stock material to a dispensing outlet 83 at the outlet end of a forming member 84.

The dispensing outlet and 83 and/or forming member 84 can be provided in any of the above described manners. In the dunnage system shown in FIGS. 10-12, the forming member 84 is in the form of a converging chute having a mounting flange for attachment to one of the top flaps at an opening therein. As above described, the forming member can be stowed inside the container atop the dunnage supply when the container is closed. For use, the forming member can be attached as above described to the top flap at an opening therein. Alternatively, the forming member can be in the form of a plastic sheet as in the embodiment shown in FIGS. 1-4.

Figure 32:
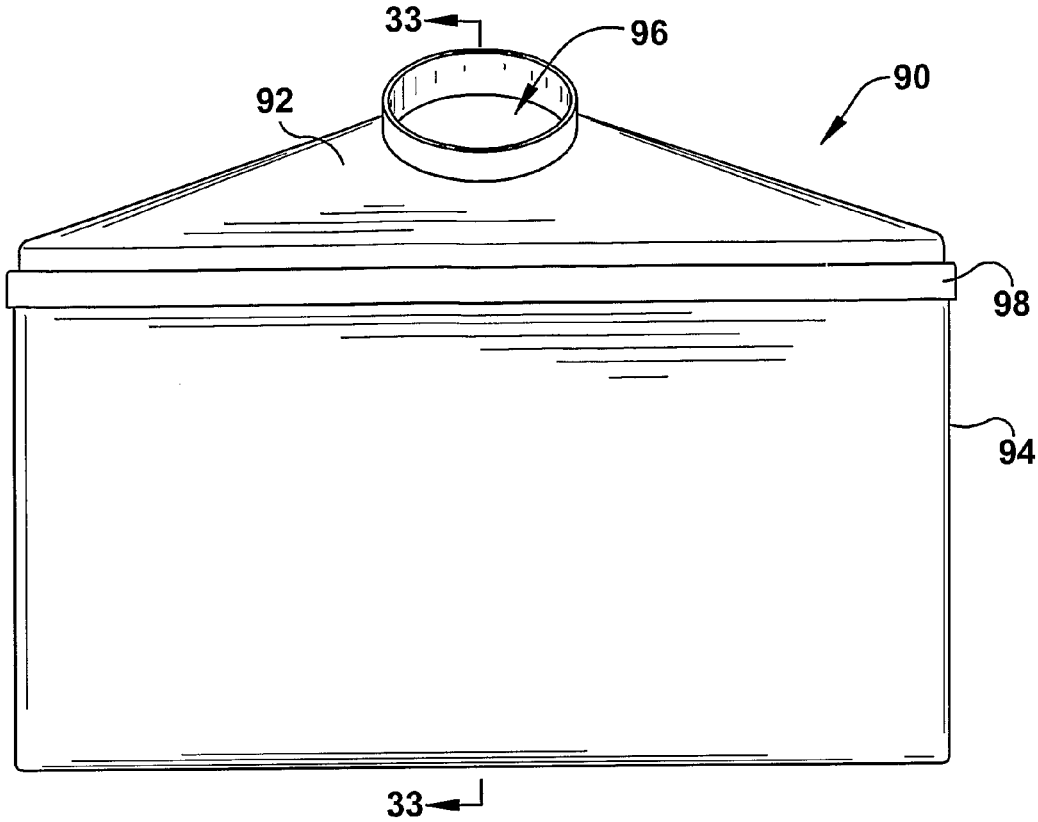
FIG. 32 is a front elevation view of another dunnage system in accordance with the invention.
Figure 33:
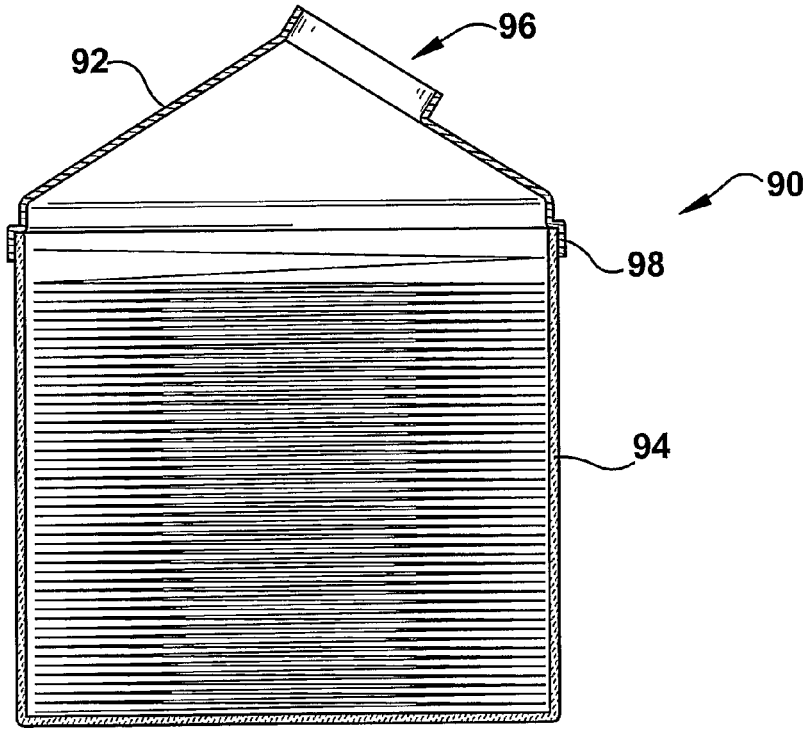
FIG. 33 is a cross-section view of FIG. 32 as seen along lines 33-33.

Additionally, in another embodiment shown in FIGS. 32 and 33, a dunnage system 90 includes a forming member 92 that can be attached over an open side, such as a top side of a container 94 for sheet stock material 96. The container in this case does not need a top wall. The forming member 92 has a flange 98 that extends from the wider end of a funnel portion and outward, over the sides of the container 94 or other housing. The flange facilitates attachment to the container and can help to hold the forming member in place relative to the container, such as barbs or teeth formed in the flange, adhesive, or other fasteners. The forming member 92 can be removed and re-used with another container 94 containing a new supply of stock material. This arrangement makes replacing the supply of stock material a simple matter, generally requiring only minor assembly such as mounting the forming member and/or repositioning the top wall of the container. A perceived advantage of this type of forming member is that the forming member can provide a smooth transition to the outlet from the extents of the housing.

Figure 13:
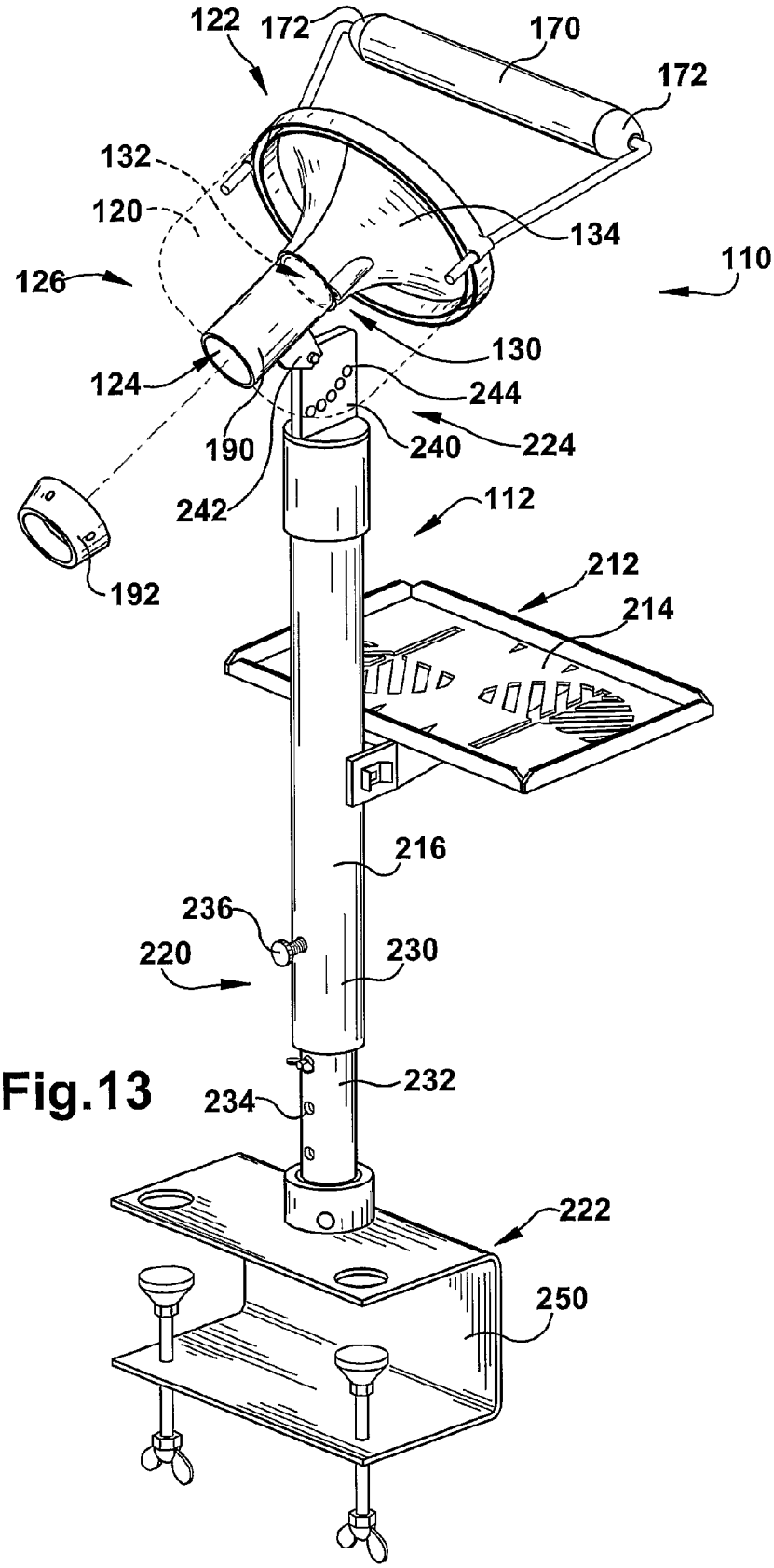
FIG. 13 is a partially exploded, perspective view of another exemplary embodiment of a dunnage system according to the present invention.

Referring now to FIG. 13, another exemplary embodiment of a motor-free dunnage system according to the present invention is shown that includes a converter 110 mounted on a stand 112. The converter 110 includes a housing 120 having an inlet at an upstream end 122 for receiving sheet stock material from a supply thereof and a reduced area outlet 124 at a downstream end 126 thereof from which a crumpled strip of dunnage can be pulled by a user. The housing 120 can be made of plastic or sheet metal, for example. The housing 120 is shown substantially in dashed lines to reveal internal features of the converter 110 that are described in the following paragraphs.

The housing 120 contains or forms therein a constraint 130 downstream of the inlet that has an aperture 132 through which the sheet stock material is drawn to form the dunnage strip. The constraint 130 is a reduced size outlet (relative to the inlet upstream thereof) and the aperture 132 is the passage therethrough that is defined by the outlet. The aperture 132 in the constraint 130 has a width that is less than the width of the stock material so that lateral regions of the stock material will be drawn (gathered) inwardly and crumpled as the stock material is pulled through the aperture 132 and out of the outlet.

In the illustrated embodiment, the constraint 130 is formed by the downstream end of a forming member such as the tapering, circumferentially converging chute or funnel 134. The converging chute 134 has a gradually decreasing cross-sectional area going in the downstream direction. The chute can be circular in cross-section as shown or can have a different configuration. The chute 134 can be enclosed within the housing 120 or can be formed by an interior surface of the housing. Thus the housing 120 and/or the converter 110 include or are integral with a forming member in the form of the chute 134.

Figure 14:
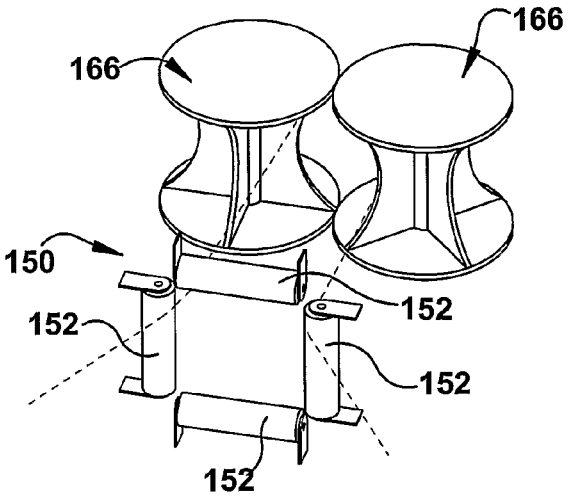
FIGS. 14 and 15 are schematic views of alternative conversion devices that may be used in a dunnage system according to the present invention.
Figure 15:
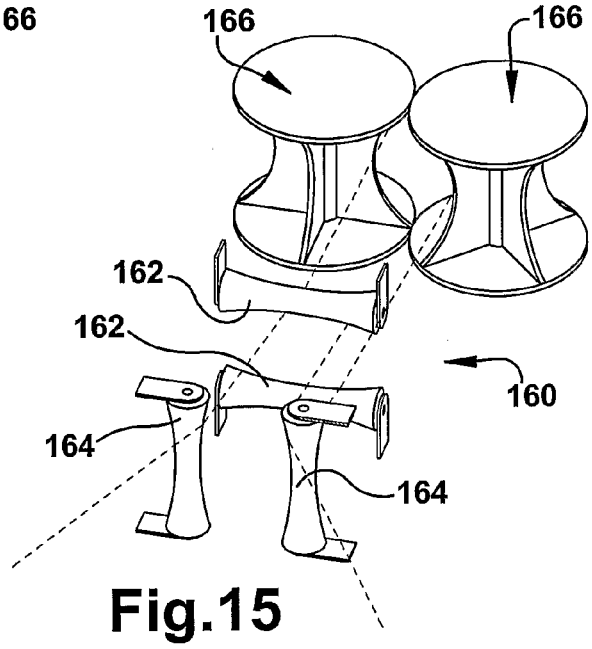

The constraint can take other forms other than the narrow end of the chute 134 shown in FIG. 13. In FIGS. 14 and 15 the constraint 150, 160 includes a plurality of rollers 152, 162, 164 between which the stock material is drawn. In FIG. 14, four cylindrical rollers 152 are arranged to define a square. Alternatively, as shown in FIG. 15, the rollers 162, 164 can have a concave profile, with respective horizontal and vertical pairs of rollers 162, 164, with the rollers within each pair 162, 164 spaced from each other to define a path therebetween for the stock material, and the rollers 162 of one pair being longitudinally spaced downstream of the rollers 164 of the other pair.

The converter can optionally be provided with one or more freely rotatable members 166 downstream of the constraint in addition to or in place of the constraint. The rotatable members 166 can be in the form of concave rollers, such as the illustrated paddle wheels, that entrain the stock material therebetween, or in the form of gears, rollers or the like. The illustrated paddle wheels 166 can be like the paddle wheels shown and described in U.S. Pat. No. 6,676,589, for example, which is hereby incorporated by reference in its entirety. Thus the paddle wheels each can have a plurality of circumferentially spaced-apart, radially-extending paddles. Each paddle has at its radially outer end an aperture formed by its concave edge. The paddles thus gather and capture the crumpled strip therebetween as the crumpled strip is drawn between the paddles. As the crumpled strip is drawn between the paddles, the paddles will rotate and assist in forming the finished crumpled strip of dunnage that exits the converter through the outlet.

Returning to FIG. 13, the converter 110 typically is provided with a transversely extending guide member 170 upstream of the converging chute 134 for guiding the stock material into the chute. More particularly, the guide member 170 defines a line of constant entry for the stock material as it is drawn into the inlet of the chute from a replaceable supply of stock material, such as fan-fold stock material supported on a tray provided on the stand 112.

Figure 16:
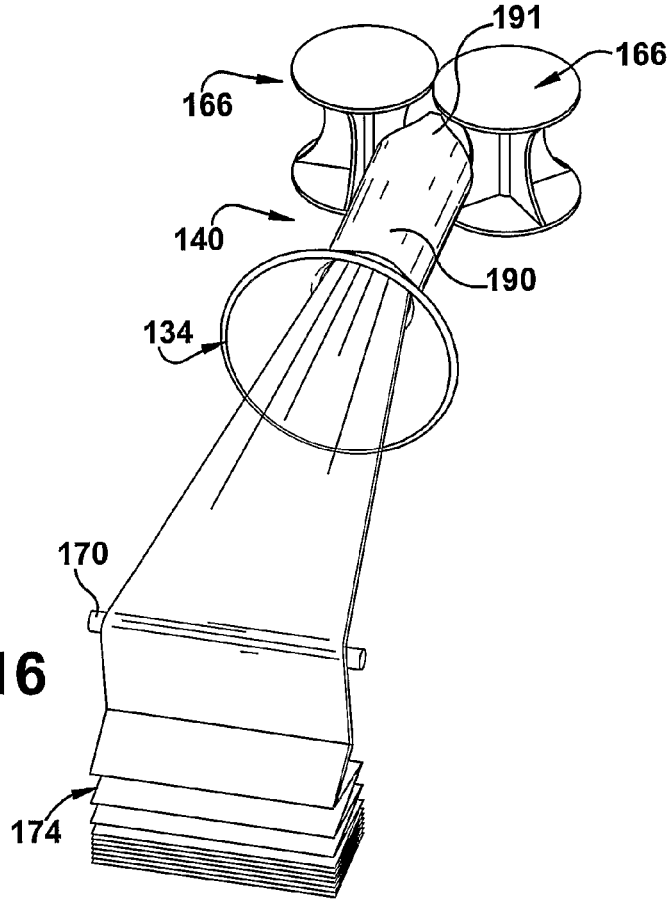
FIG. 16 is a schematic view of another embodiment of a dunnage system according to the present invention.

The transversely extending guide member 170 over which the stock material is drawn into the housing 120 can be integral with the housing or can be spaced from the upstream end 122 of the housing 120 as shown in FIG. 13. The guide member 170 also can have a portion that is rotatable about its longitudinal axis, and can include multiple longitudinal sections with different angles between the longitudinal axes of each section. The guide member 170 can be generally cylindrical with lateral end portions 172 whose diameter decreases when moving laterally outward along its longitudinal axis. This creates curved surfaces at laterally spaced portions of the path of the stock material that are believed to minimize or prevent premature tearing at the edges of the stock material 174 (FIG. 16) as the converging chute 134 and the constraint 140 gather together the lateral portions of the stock material.

In the dunnage converter 110 the constraint 140 can be continued downstream thereof by means of a tubular section 190. In the illustrated embodiment the tubular section 190 is cylindrical and circumferentially constrains the crumpled strip as it moves therethrough. The tubular section 190 terminates at an outlet end 191. The outlet end may have attached thereto or integrally formed therewith a nose piece 192 at the dispensing outlet.

Figure 17:
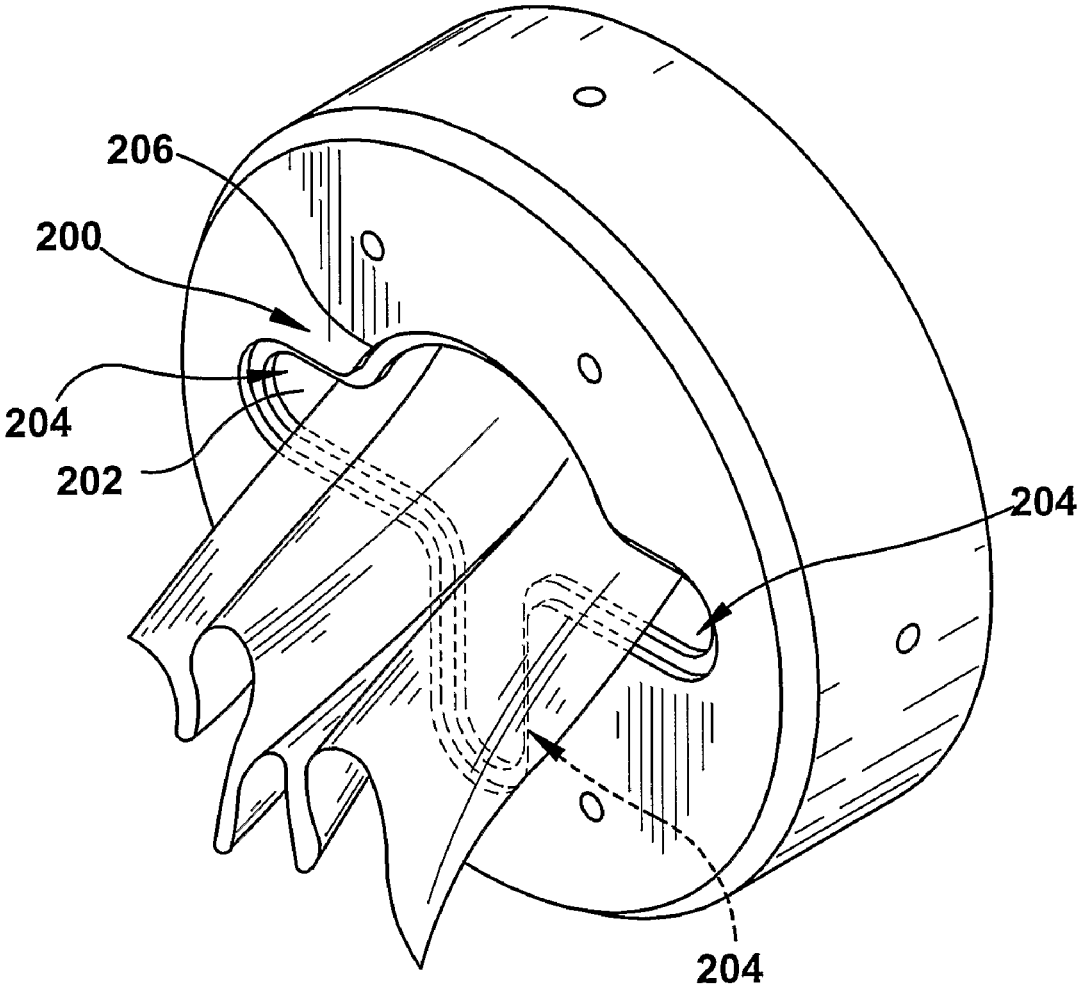
FIG. 17 is an enlarged view of an exemplary catch device for a dunnage converter system according to the present invention, such as that shown in FIG. 13.
Figure 18:
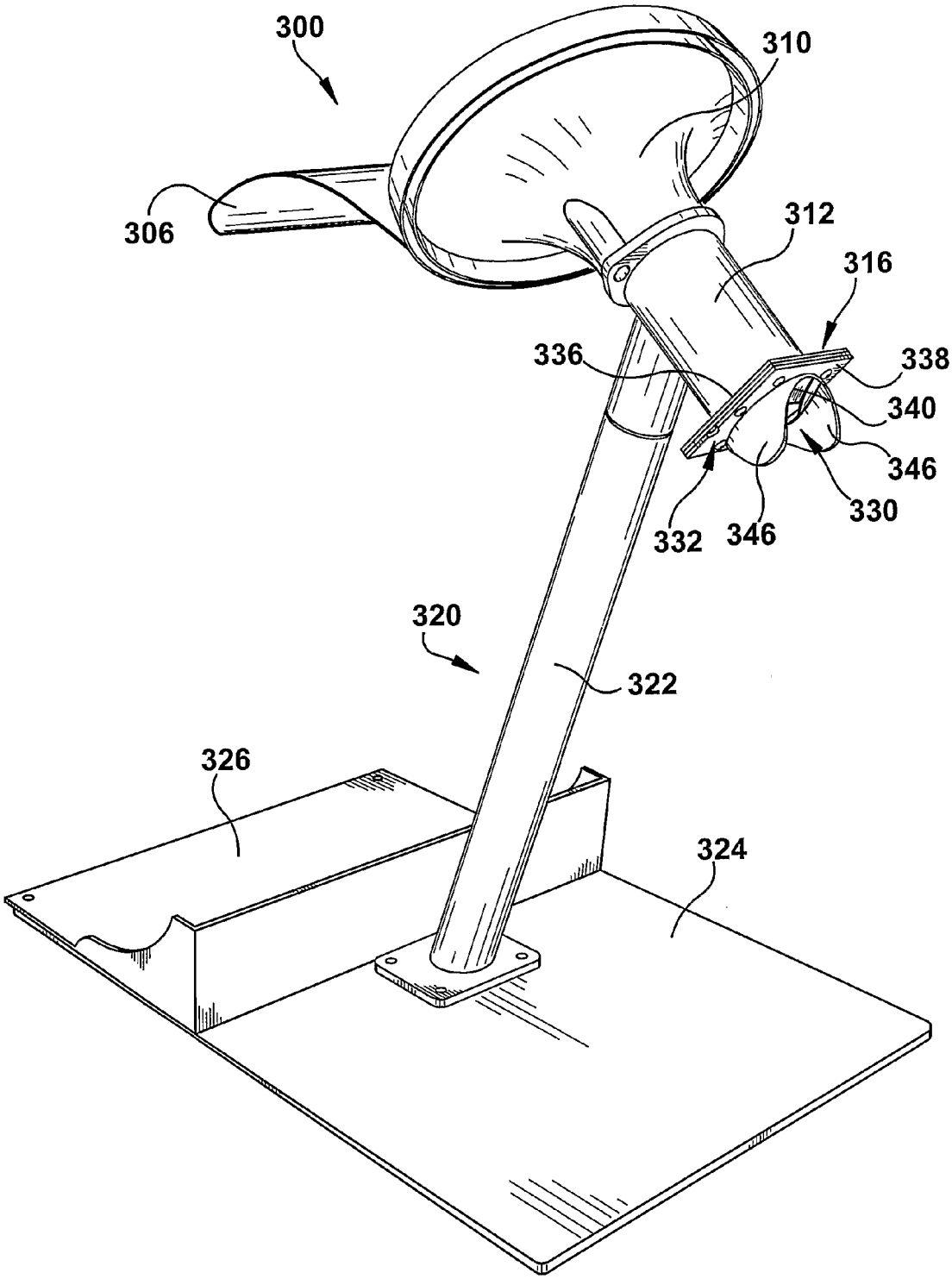
FIG. 18 is a front-left perspective view of another exemplary dunnage system according to the present invention.
Figure 19:
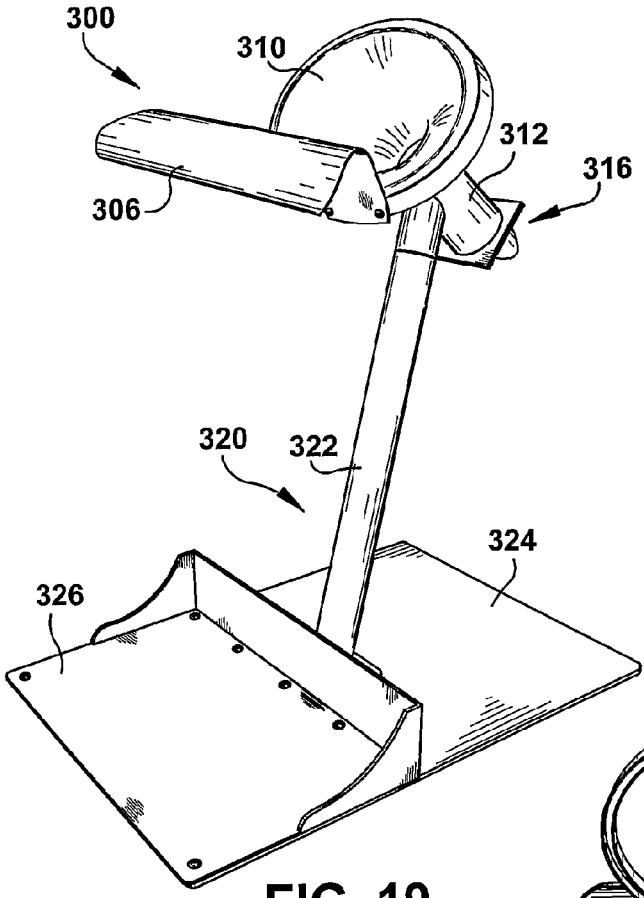
FIG. 19 is a rear-left perspective view of the system of FIG. 18.
Figure 20:
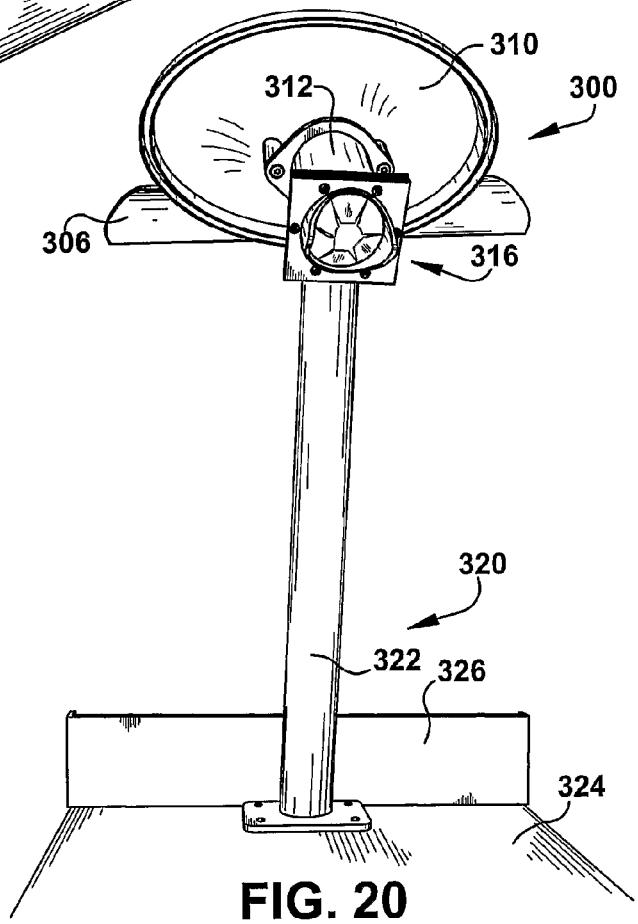
FIG. 20 is a front view of the system of FIG. 18.

The nose piece 192 can be replaced with a catch/cutting device 200 such as that shown in FIG. 17. This catch device 200 includes a wall having an opening 202 therein through which the crumpled strip is pulled. The opening 202 can be generally circular except for one or more generally radially extending, narrow side extensions 204, which can be referred to as notches. The width of the notches decreases in an outward direction. The illustrated embodiment includes three notches 204, two diametrically opposed notches to the right and left and a notch perpendicular thereto, straight down, which is partially obscured by the dunnage material therein in FIG. 17. The cylindrical output chute 190 or the catch device 200 can be rotatable about a longitudinal axis to change the orientation of the catch device. The wall including the opening can be formed of a metal material such as steel, or the opening 202 can be lined with a metal such as steel, as metal and particularly steel has been found to have an advantageous gripping capability with kraft paper.

The catch device 200 is used to assist in separating a length of dunnage. After an operator, e.g. a packer or other user, pulls a desired length of dunnage from the converter, the operator can jerk the strip sideways relative to the axis of the passage, whereupon the strip will move into one of the notches. As the strip is forced into the notch, it will be gripped by the notch and thus held against further withdrawal from the converter. If the strip is provided with longitudinally-spaced, transversely extending weakened regions, such as a transverse rows of perforations, the strip can be torn along a row of perforations located at or downstream of the device 200.

If the stock material is not perforated or otherwise weakened, the catch device 200 can still assist in severing the strip, such as by holding the strip to facilitate cutting of the strip with a knife. Alternatively, the device 110 can have associated therewith a knife edge for cutting the strip when the strip is moved against the knife edges. To this end, the device 200 can include a cutting blade forming one or more knife edges at the sides of the opening and particularly the sides of the notches. The knife edge can be straight, curved, serrated or have another shape. Another example of a catch device includes a serrated edge at a side thereof, where the tips of the serrations can bite into the stock material to hold it in place while is it is pulled across the side cutting edges of the serrations for severing a dunnage product from the strip.

As shown in FIG. 13, the stand 12 may include an extension, such as an upright 216, with an optional height-adjustment mechanism 220, a base 222 and an optional angular adjustment mechanism 224. The stand 112, to which the illustrated converter 110 is mounted, also has a support 214 mounted to the upright 216 for supporting a supply of sheet stock material. In the illustrated embodiment, the stock material support 214 for the stand 212 includes a shelf for a stack of fan-folded sheet stock material. Alternatively, the support can include one or more arms for rotatably supporting a roll of sheet stock material. In the illustrated embodiment, the upright is in the form of a telescoping tube 230 and post 232, with a hole 234 in one of the tube and the post through which a pin 236 can be inserted into an aligned one of a series of holes 238 in the other of the tube 230 and the post 232 to support the housing 120 of the converter 110 at different heights. The telescoping tube 230 and post 232 can be rotatable or otherwise repositionable relative to each other to change the outlet direction of the converter, preferably between a limited number of positions.

At an upper end of the upright 216, the angular adjustment mechanism 224 includes a pair of plates 240, 242 secured together and rotatable relative to each other. At least one of the plates has a series of holes 244 through which a pin 246 can be inserted into an aligned hole 248 in the other plate to fix the relative angular position of the plates, thereby holding the housing 120 of the converter 110 in a particular angular orientation. The user can adjust the orientation of the housing 20 relative to the stand 112 that supports the housing 120 and the supply of stock material by adjusting the height and/or the angular orientation of the housing 120 relative to the upright 216.

At an opposite end of the upright 216, the base 222 may include a clamp 250 for mounting the stand 112 to a generally horizontal member or surface, such as a table top, for example. If the table has wheels, the table can be used as a mobile packing station with the top of the table forming a packing surface. Because no power supply is needed for the converter, there are no cords to move or entangle, for example, as the packing station is moved. Other types of bases can be provided in place of the illustrated clamp, however, including a flat plate for supporting the upright on a surface, an H-shape base, a V-shape base, a table or a shelf.

In use of the dunnage system 110, the sheet stock material is pulled into the inlet at the upstream end 122 of the housing 120 from a supply thereof as crumpled sheet stock material, i.e., a dunnage strip, is pulled the dispensing outlet. The user can move the dunnage material relative to the catch device 200 to catch and sever the dunnage strip, either by moving it against a knife edge or tearing it along a perforated tear line, for example.

Referring now to FIGS. 18-22, another a motor-free dunnage system 300 according to the present invention is shown. An operator draws a sheet stock material 302 from a supply 304 thereof over a guide member 306 and into a housing that includes a converging chute 310 that acts as a forming member. The sheet stock material 302 moves through the chute 210 and a tubular section 312, and the operator pulls a dunnage material 314 out a dispensing outlet and past a catch device 316, where a section thereof can be severed for filling a void around one or more objects in a container.

The dunnage system 300 also includes a stand 320. The stand 320 includes an extension in the form of an upright 322, to which the converging chute 310 is mounted, and a base 324 that includes a tray 326 for supporting a supply of fan-folded sheet stock material, such as kraft paper. The upright 322 is to inclined slightly relative to vertical to facilitate pulling dunnage from the converter 300 toward a container below the outlet thereof where the void in the container therein can be filled with dunnage.

In the illustrated dunnage conversion system 300, the converging chute 310 and the tubular section 312 extending from the narrow end of the chute 310 are the same as the converging inlet chute 134 and tubular outlet chute 190 of the dunnage system 110 shown in FIG. 13.

Unlike the dunnage system shown in FIG. 13, the transversely extending guide in FIG. 17 is in the form of a forming plow 306. The forming plow 306 provides a constant point of entry and thus a constant path to the converging chute 310 for the stock material 302 as the supply 304 is drawn down. The forming plow 306 extends in an upstream direction, away from the converging chute 310 and presents a laterally extending curved surface spaced from the converging chute 310 over which the sheet stock material 302 is drawn into the chute 310. The forming plow 306 generally is wider at an upstream end thereof, and has a J-shape longitudinal cross-section with the end of the upright portion of the J-shape connected to the chute 310. The distal, upstream end of the J-shape faces away from the chute inlet and presents a curved surface to the stock material. The forming plow 306 typically is plastic, and can be connected to or molded as an integral part of the chute 310. In operation, the forming plow 306 guides the stock material 302 from the supply 304 into the converging chute 310 and cooperates with the converging chute 310 to encourage lateral portions of the sheet stock material 302 to turn inwardly as it enters the converging chute 310.

The stock material 302 inwardly crumples as it passes through the restriction (i.e. constraint) at the smaller end of the circumferentially converging chute 310 and moves through the tubular section 312 and out the dispensing outlet and past the catch device 316. As the operator pulls the dunnage material 314 out the catch device 316, the stock material 302 is pulled from the supply 304 and crumpled in the chute 310 and tubular section 312. As in the previous embodiments an exemplary stock material 302 is a fan-folded, sheet stock material, such as kraft paper, that is perforated at lateral perforation lines extending across the width of the stock material at regular intervals to separate at a perforation line at or downstream of the catch device 316.

Figure 21:
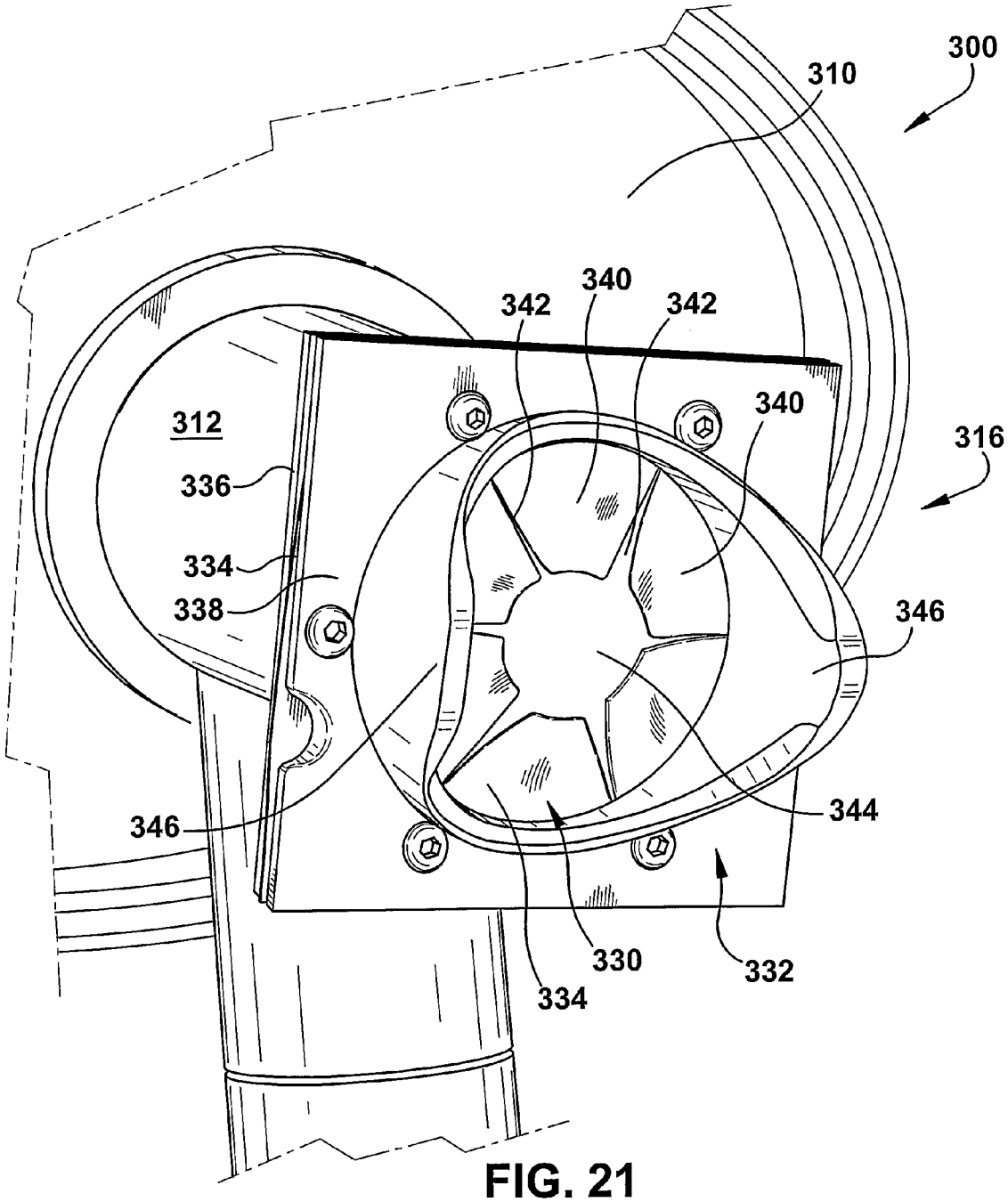
FIG. 21 is an enlarged view of the outlet of the system of FIG. 18.
Figure 22:
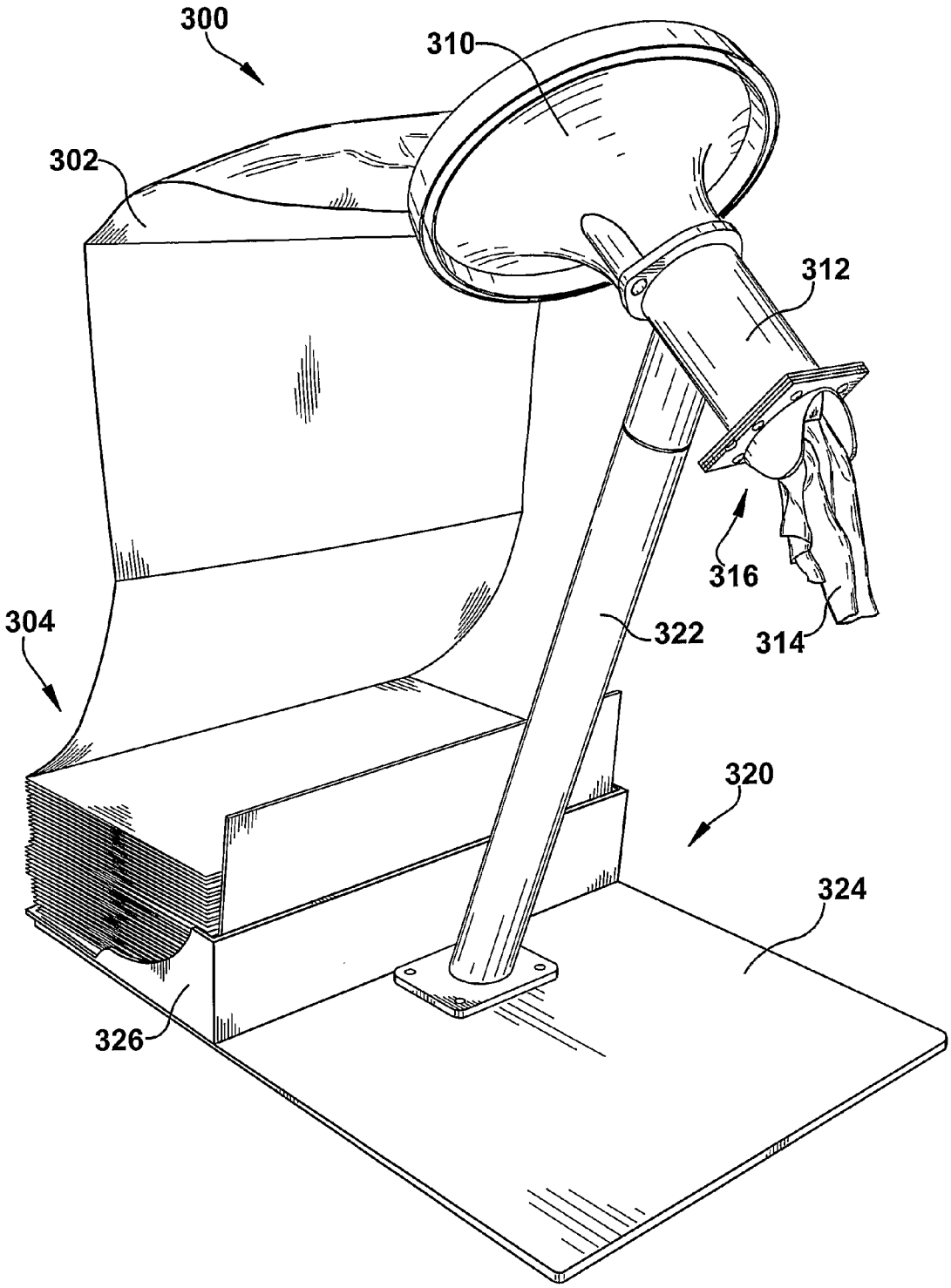
FIG. 22 is a view similar to FIG. 18, showing the sheet stock material being drawn through the system to produce a dunnage product.

As best shown in FIG. 21, and referring also to FIGS. 17 and 22, the catch device 316 includes a gripper 330 and a nose piece 332 that cooperate to hold the dunnage 314 when an operator moves the dunnage strip to tear off a section of dunnage material. The catch device 316 in this embodiment is very simple and inexpensive to manufacture. The gripper 330 includes a plastic plate 334 secured between a flange 336 at the downstream end of the tubular section 312 and a flange portion 338 of the nose piece 332. The plastic plate 334 includes a series of flexible segments 340 separated by radial slits 342. The segments 340 extend radially inwardly to define a central opening 344 that is smaller than the internal diameter of the tubular section 312. As the dunnage 314 is pulled through the catch device 316, the flexible segments 340 tend to crease the crumpled folds in the dunnage, hindering yet allowing the passage of the dunnage 314 therethrough.

The nose piece 332 includes a pair of laterally spaced fingers 346 that taper in a downstream direction. When the dunnage 314 is moved sideways against a nose piece finger 346, the gripper 330 creates a torturous path from the gripper 330 to the nose piece finger 346. The gripper 330 and the nose piece finger 346 cooperate to grip the dunnage 314 as it is moved relative thereto, including sideways, to tear off a section of dunnage at a perforation line at or downstream of the catch device 316 to use in filling a void in a container.

Figure 23:
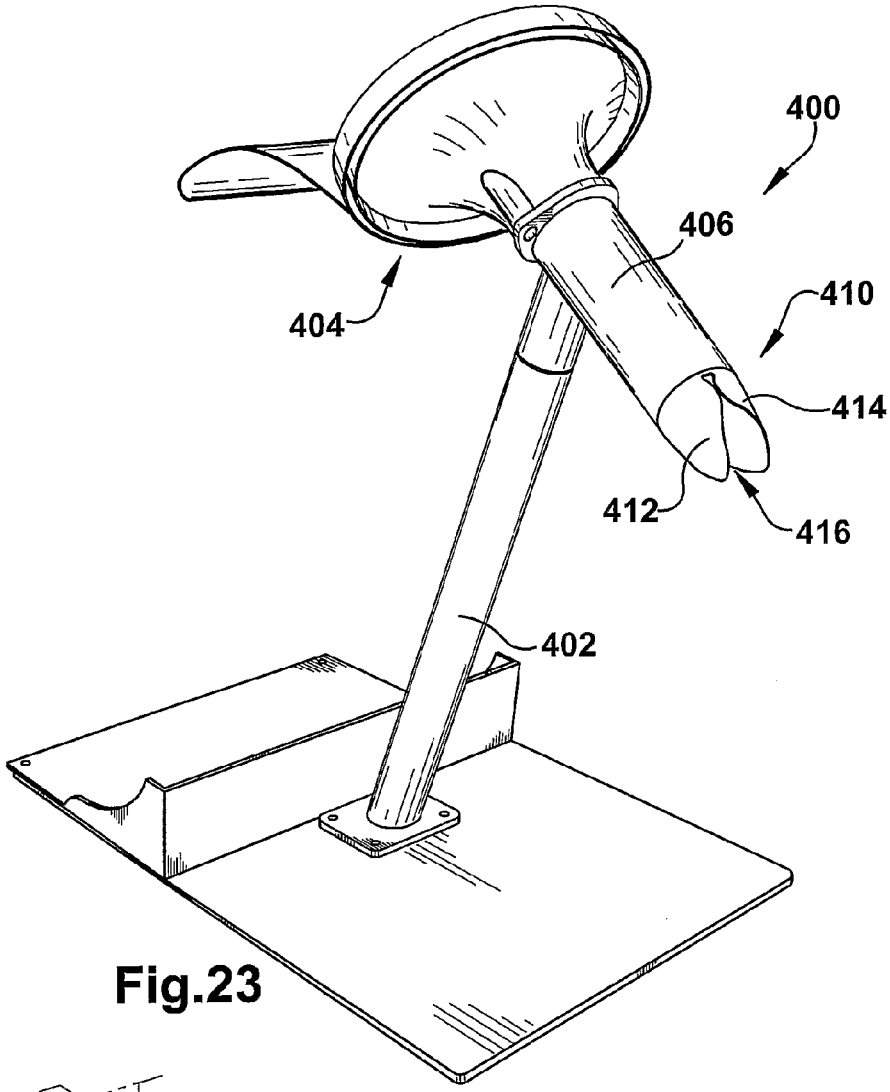
FIG. 23 is a front-left perspective view of another dunnage system in accordance with the present invention.
Figure 24:
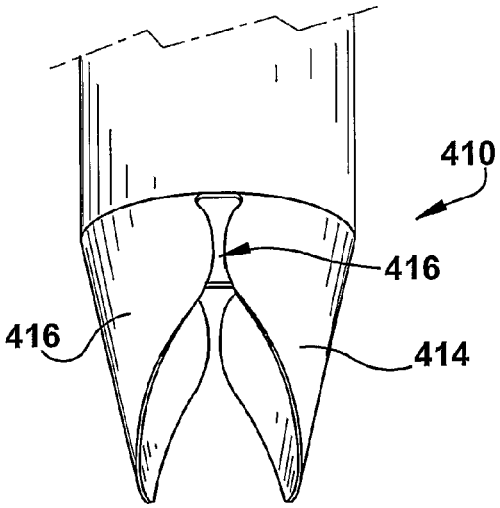
FIG. 24 is an enlarged view of the outlet of the system of FIG. 23.
Figure 25:
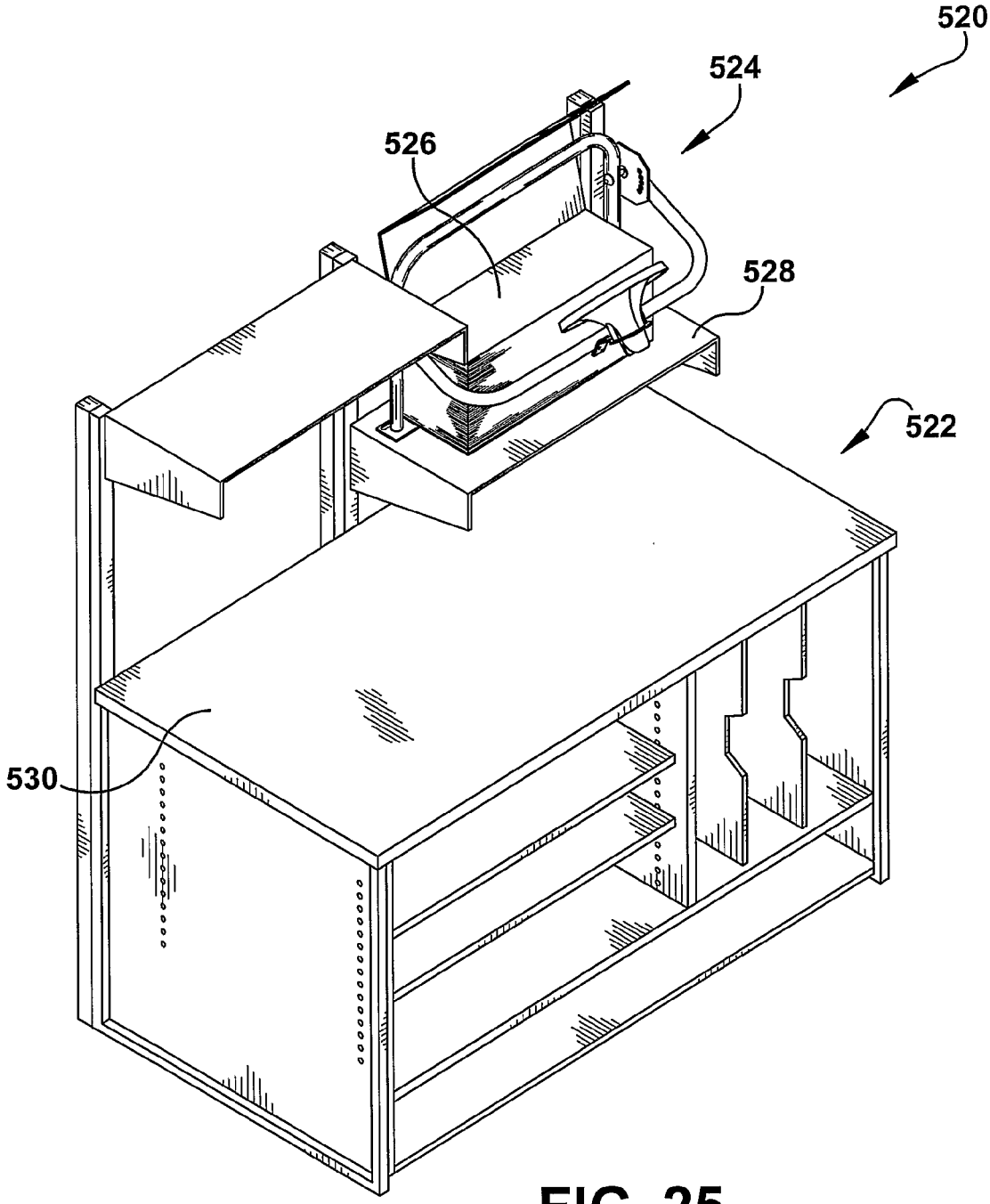
FIG. 25 is a perspective view of a packing station that includes another dunnage system according to the present invention.
Figure 26:
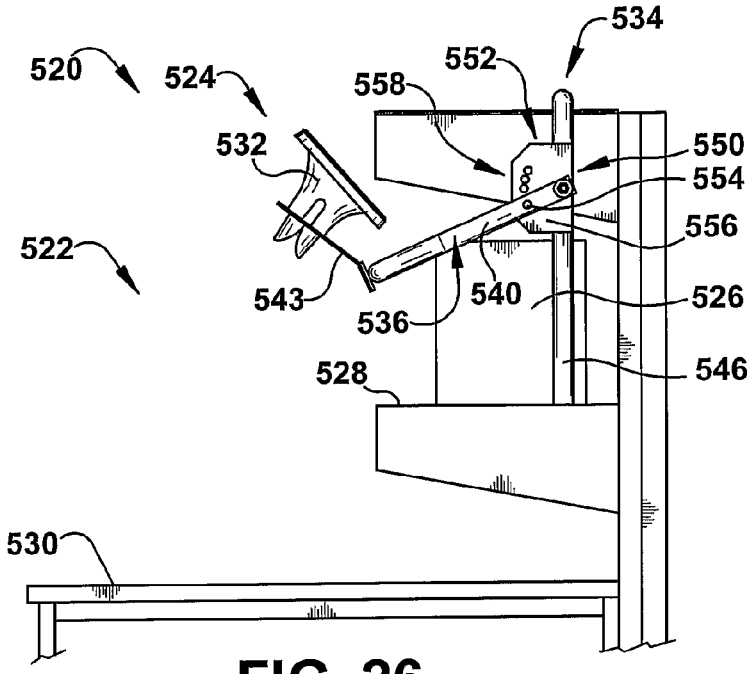
FIG. 26 is an enlarged partial side elevation view FIG. 25.
Figure 27:
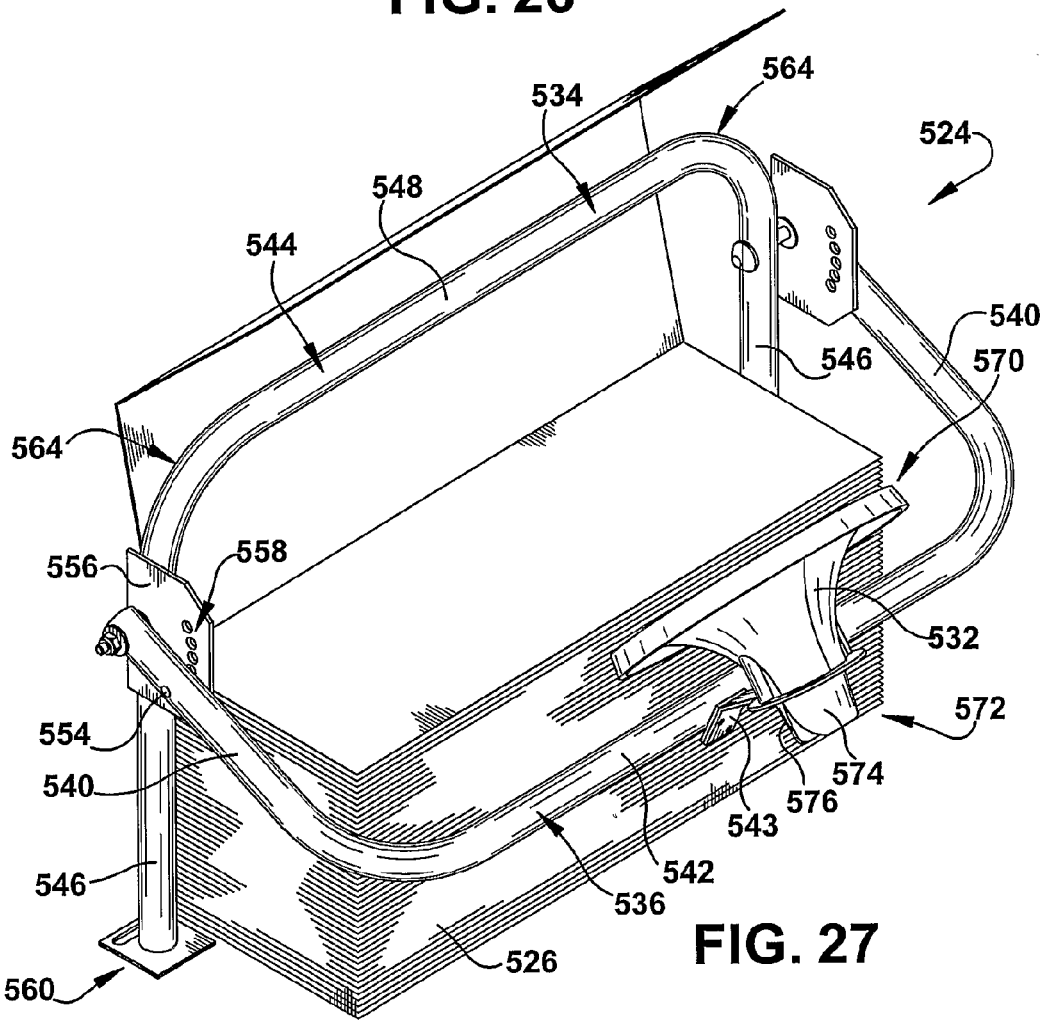
FIG. 27 is an enlarged perspective view of the dunnage system of FIG. 25.
Figure 28:
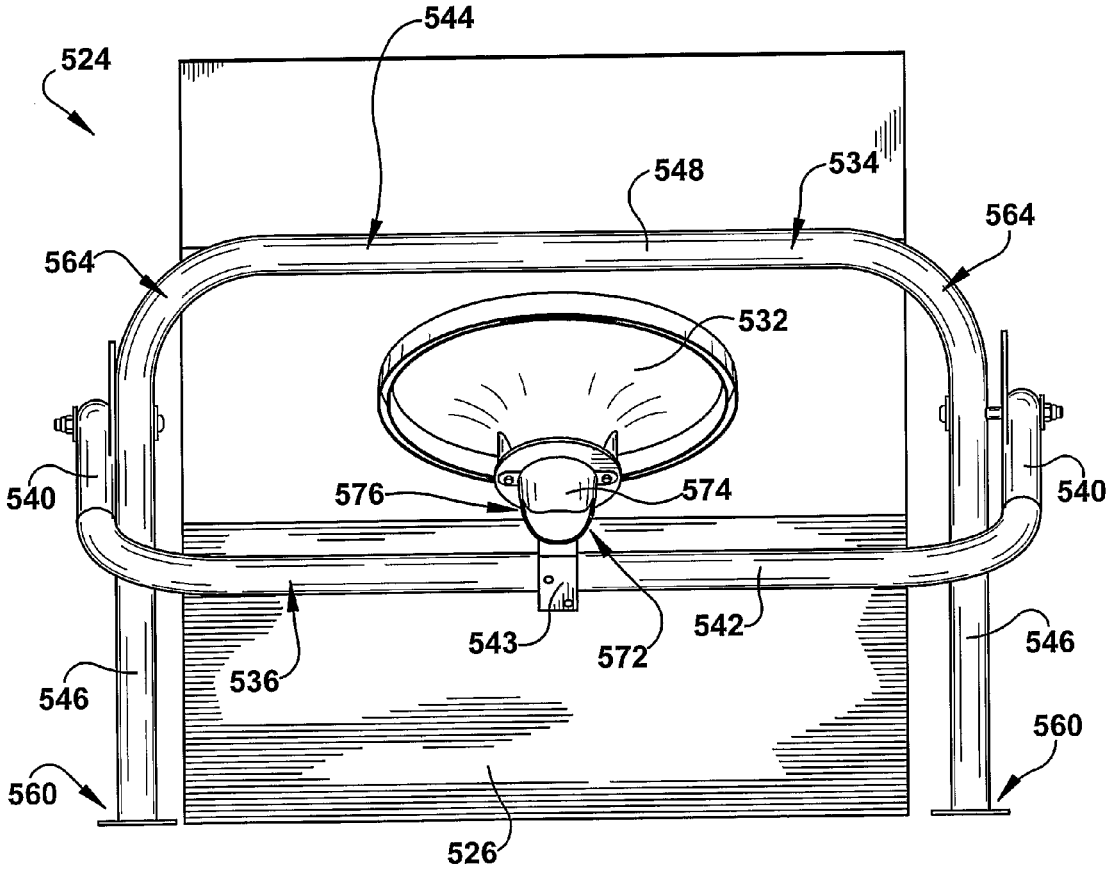
FIG. 28 is a front elevation view of the dunnage system of FIG. 25.
Figure 29:
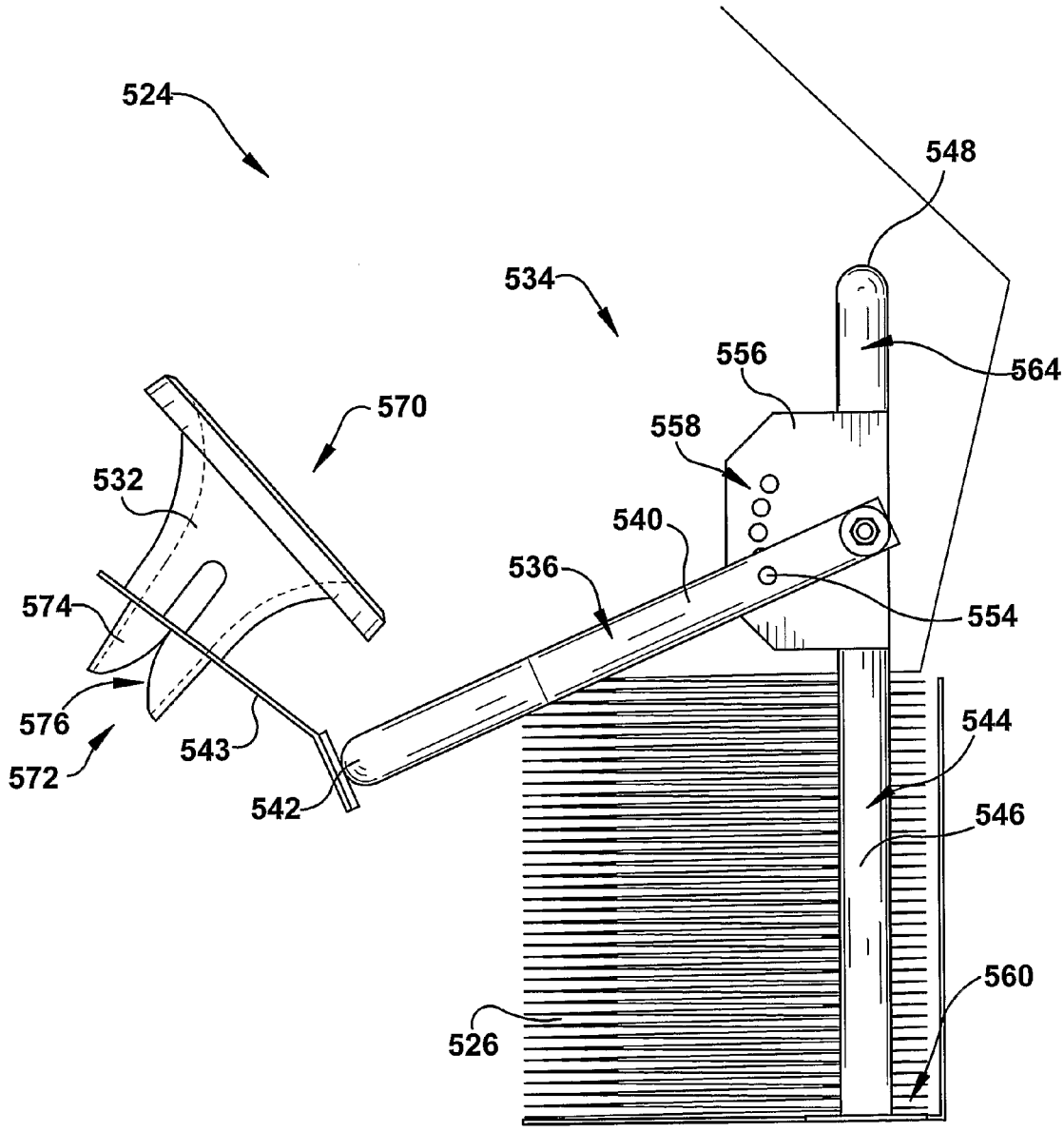
FIG. 29 is a side elevation view of the dunnage system of FIG. 25.
Figure 30:
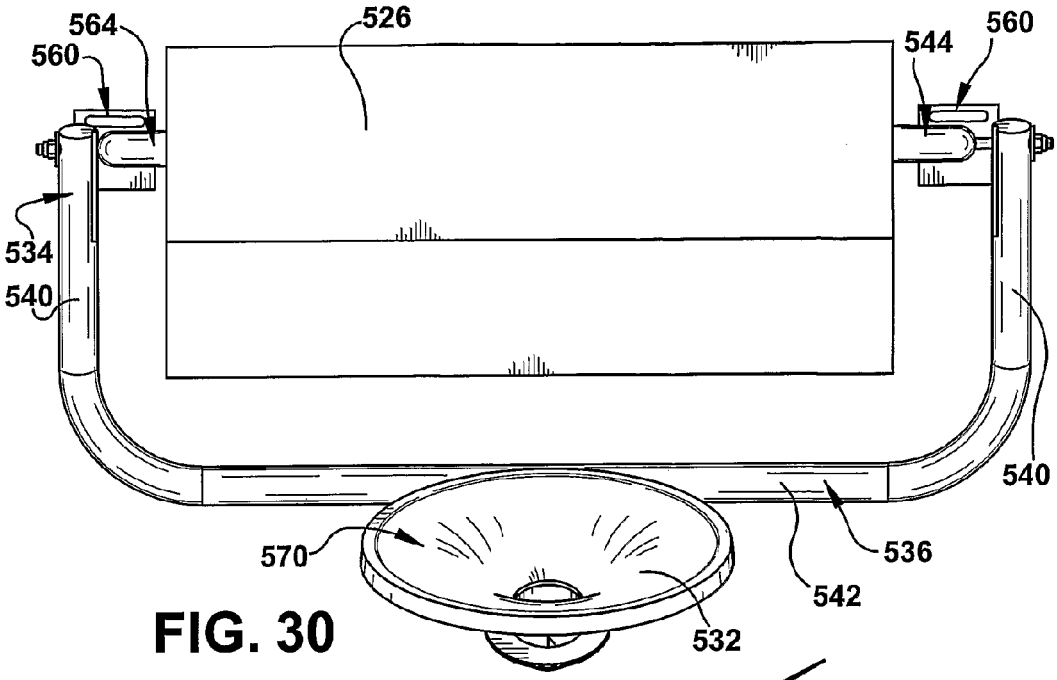
FIG. 30 is a top view of the dunnage system of FIG. 25.
Figure 31:
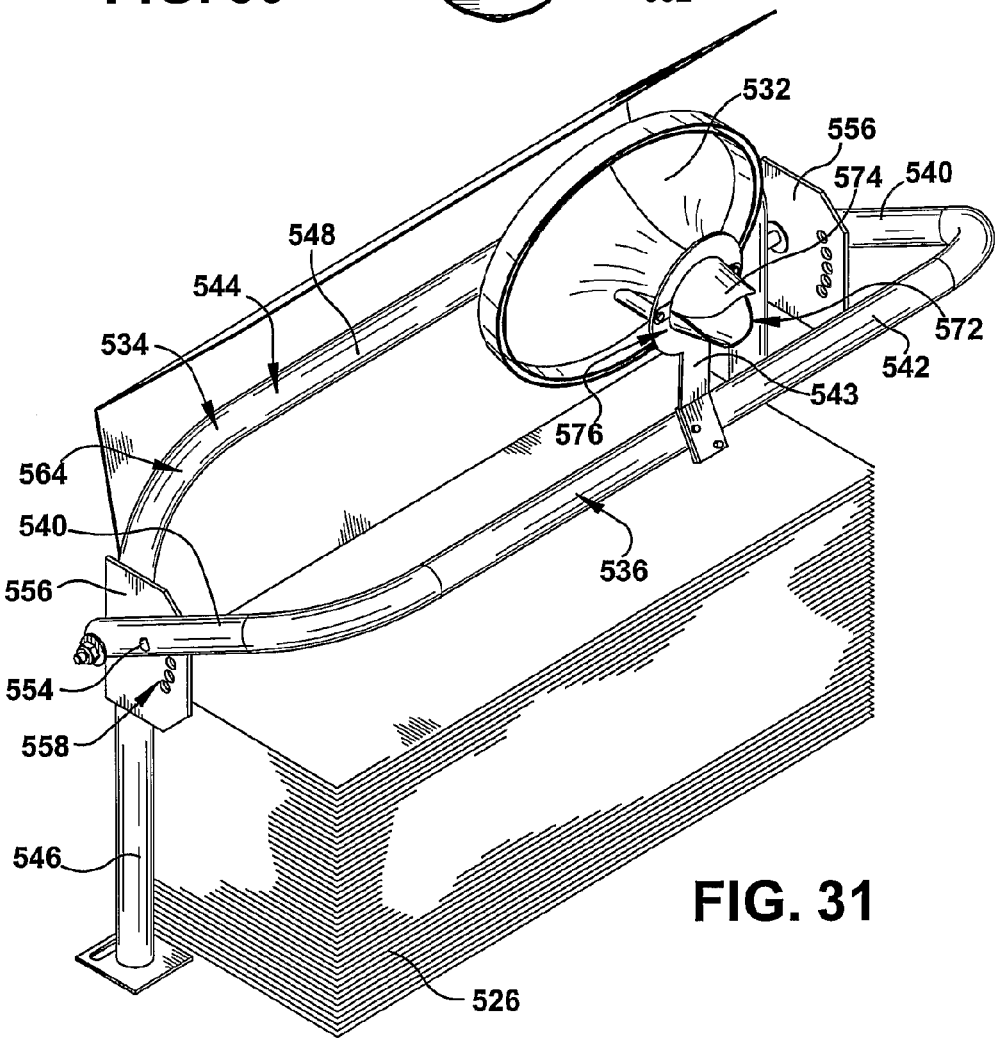
FIG. 31 is a perspective view of the dunnage system of FIG. 27, with the conversion device adjusted to a different position.

Another dunnage system or converter 400 according to the present invention is shown in FIGS. 23 and 24. The converter 400 in this embodiment is substantially similar to the motor-free converter 300 of the previous embodiment. The converter 400 is mounted on a stand 402 and includes a circumferentially converging chute 404 as a forming member. The chute 404 inwardly gathers and crumples the stock material as it moves therethrough. The converter 400 also has a tubular section 406 downstream of the converging chute 404. The tubular section 406 terminates at a dispensing outlet catch device 410 that facilitates separating one or more sections of dunnage from the crumpled strip for filling a void around one or more objects in a container.

This catch device 410 includes an axially-aligned segmented extension of the tubular section 306 through which the stock material car) pass without interference. In the illustrated embodiment the catch device 410 includes two segments 412 and 414, between which the stock material is readily pulled. Unlike the radial notches provided in the other embodiments, in this embodiment each segment 412 and 414 tapers in a downstream direction, forming longitudinally-extending notches 416 between adjacent segments. The notches 416 generally narrow in an upstream direction, and can be cut from or otherwise formed adjacent the downstream end of the tubular section 406 to form the catch device 410. The catch device 410 typically is rotatable relative to the tubular section 406 or the converging chute 404.

As the operator pulls the sheet stock material from a supply thereof into the chute 404, the chute 404 inwardly gathers and crumples the stock material as it passes therethrough. The stock material then moves through the tubular section 406 and out the dispensing outlet and past catch device 410. The catch device 410 has an axial passage therethrough that has substantially the same cross-section as the tubular section 406, and therefore adds little or no resistance to the stock material passing therethrough. When the operator has pulled the desired amount of dunnage through the converter 400, the operator can move the strip of dunnage into one of the notches 416 in the catch device 410, which grips the strip and facilitates tearing the stock material at or downstream of the catch device 410. The catch device 410 can be rotated to position the notches 416 at a convenient orientation preferred by the operator. The stock material preferably tears along a line of weakening, such as a line of perforations, across the width of the stock material. Alternatively, the catch device 410 can include a knife edge for cutting the dunnage, including, for example, the serrated edge described above.

Referring now to FIGS. 25-31, a dunnage system 520 provided by the invention is shown. This system includes a packing workstation 522 with a conversion assembly 524 for converting a supply 526 of sheet stock material into a relatively less dense dunnage product. As shown, the conversion assembly 524 is mounted to a shelf 528 above a work surface 530 at the packing station 522.

An exemplary conversion assembly 524 for converting sheet stock material into a dunnage product comprises a forming member or a converter device 532 through which the sheet stock material is drawn and crumpled to form a dunnage product, and a stand 534 for supporting the converter device 532. The stand 534 includes a first U-shape member 536 having a pair of arms 540 projecting from a central portion 542 to which the converter device 532 is mounted via a bracket 543, and a second U-shape member 544 having a pair of legs 546 projecting from a central portion 548, the arms 540 of the first U-shape member 536 being attached to and extending from respective legs 546 of the second U-shape member 544. The shelf 528 and the supporting structure of the workstation 522 provide a base for the stand.

The arms 540 of the first U-shape member 536 preferably are pivotally attached to the legs 546 of the second U-shape member 544 for relative pivotal adjustment of the first and second U-shape members 536 and 544. In addition, a detent mechanism 550 is provided to afford discrete pivotal adjustment positions of the first and second U-shape members 536 and 544.

As shown, a hinge 552 comprising a pair of hinged parts is used to secure the arms 540 to the legs 546, with one part attached to the respective arm 540 and the other part attached to the respective leg 546. The two parts of the of the hinge 552 can be in the form of plates that are pivotally connected together and which slide against one another. One plate (or one or both arms 540 as shown in the illustrated embodiment) can be provided with a retractable protrusion 554 and the other plate 556 can be provided with an arcuate array of recesses 558 for receiving the protrusion at any one of several angular spaced apart positions (compare FIGS. 29 and 31, for example).

Preferably, one or both of the first and second U-shape members 536 and 544 are formed from tubes. The tubes each can be formed from several interconnected sections as can be desired to facilitate packaging thereof, along with the converter device 532, in a compact configuration.

The legs 546 of the second U-shape member 544 terminate at an attachment device 560 for enabling connecting to the base or an external component. As shown, the attachment device 560 can be mounting feet or plates to fixed to the ends of the legs 546 which include one or more fastener holes for securement of the legs to a support, such as a shelf 528 of the workstation 522 as shown. In the illustrated embodiment, the shelf 528 also is used to support the supply 526 of stock material, and specifically a stack of fan-folded stock material. The second U-shape member 544 straddles the stock supply 528 in this embodiment.

Instead of a fan-folded stack, the supply 526 can include a roll of one or more plies of sheet stock material. Brackets can be attached to the second U-shape member 544 to support a stock roll holder, or the stock roll can be separately supported for rotation as the stock material is drawn therefrom.

Preferably, the central portion 548 of the second U-shape member 544 functions as a guide for guiding the sheet stock material to the converter device 532. The central portion 528 of the second U-shape member 544 preferably has laterally spaced-apart curved ends 564 over which the stock material is drawn to initiate inward folding of the stock material. Alternatively, the second U-shape member 544 can be replaced by a pair of spaced-apart upright legs and a different transversely extending guide member upstream of the converter device 532 that guides the stock material into the converter device 532. The guide member can be mounted to the upstream end of the converter device or to the first U-shape member 536 for movement therewith, or can be mounted to one or both of the upright legs. As with the illustrated central portion 548 of the second U-shape member 544, any other transversely extending guide preferably has curved ends to facilitate initial inward turning of lateral portions of the stock material to minimize excessive tension that might lead to premature tearing of the stock material.

The subject configuration of the stand 534 is inexpensive and easy to fabricate, and yet the illustrated stand also provides flexibility in positioning the converter device 532 to suit a particular packer's preferences.

The converter device 532 can be any suitable forming member for converting a sheet stock material into a dunnage product, such as the illustrated converging chute or a conversion assembly that includes one or more rotating members that act on the stock material, for example, including a powered converter device can be used, such as that disclosed in U.S. patent application Ser. No. 10/887,220 filed Jul. 8, 2004.

The illustrated converter device 532 is in the form of a tapering (converging) chute or funnel. The upstream or inlet end 570 of the converter device 532 has a larger cross-sectional area than the downstream or outlet end 572 of the converter device 532. The cross-sectional area of the chute can be circular as shown or can have a different configuration. The downstream end 572 of the chute forms a dispensing outlet with a width that is less than the width of the stock material so that lateral regions of the stock material will be drawn (gathered) inwardly and crumpled as the stock material is pulled through the dispensing outlet.

The outlet end 572 of the converter device 532 also includes a catch/cutting device 574. As shown, the outlet end 572 of the converter device 532 has one or more longitudinally extending notches 576. The notches 576 have a decreasing width in the upstream direction. A crumpled strip of dunnage can be moved into the notch 576, which grips the strip therein, facilitating separating a length of dunnage in the following manner.

After an operator, e.g. a packer, pulls a desired length of dunnage from the converter device 532 and through the dispensing outlet, the operator can jerk the strip sideways, transverse the axis of the passage through the converter device 532, whereupon the strip will move into one of the notches 576. As the strip is forced into the notch 576, it will be gripped by the notch 576 and thus held against further withdrawal from the converter device 532. If the strip is provided with longitudinally-spaced, transversely-extending weakened regions, such as a transverse rows of perforations, the strip can be torn along a row of perforations located at or downstream of the catch/cutting device 574.

If the stock material is not perforated or otherwise weakened, the catch device 574 can still assist in severing the strip, such as by holding the strip to facilitate cutting a section of dunnage from the strip with a knife. Alternatively, the catch device 574 can have associated therewith a knife edge for cutting the strip when the strip is moved relative thereto. To this end, the catch device 574 can include a cutting blade forming one or more knife edges at the sides of the outlet opening and particularly the sides of the notches 576, as discussed above.

In summary, the present invention provides a motor-free dunnage system that does not require a motor to feed the stock material, to affect the shape of the crumpled dunnage product or to sever discrete dunnage products. A motor requires a source of power, fuel or electricity, for example, and such power sources might not be conveniently available at the location where the converter is being used. Moreover, without a motor, the converter generally will be lighter weight. The lighter weight in turn makes the converter more portable and easier to move to different locations. Finally, the very simplicity of the converter and its lack of many (if any) moving parts generally makes it easier and less expensive to build, maintain and operate.

Although the invention has been shown and described with respect to a certain embodiment, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer that performs the specified function of the described integer (i.e., that is functionally equivalent), even though not structurally equivalent to the disclosed structure that performs the function in the herein illustrated exemplary embodiment of the invention.

What is claimed is:

1. A motor-free dunnage system for converting sheet stock material into a relatively less dense dunnage product, comprising a forming member having a converging side wall or walls that terminate at a reduced-size outlet through which a user can draw sheet stock material and thereby crumple the sheet stock material as it is drawn therethrough to form a relatively less dense strip of dunnage, and a stand to which the forming member is mounted, wherein the stand includes a base and an extension mounted to the base for supporting the forming member at a position removed from the base, wherein the forming member is mounted to the stand, the stand including a first generally U-shape member having a pair of arms projecting from a central portion, and a second generally U-shape member having a pair of legs projecting from a central portion, the arms of the first U-shape member being attached to and extending from respective legs of the second U-shape member, and the forming member is mounted to the central portion of the first U-shape member.

2. A system as set forth in claim 1, without moving parts.

3. A system as set forth in claim 1, wherein the stand includes a detent mechanism that provides a plurality of discrete positions of the first member relative to the second member.

4. A system as set forth in claim 1, wherein the stand includes a base and the legs of the second U-shape member are mountable to the base and extend therefrom.

5. A system as set forth in claim 1, wherein the central portion of the second U-shape member functions as a guide for guiding the sheet stock material from a supply thereof to the forming member.

6. A system as set forth in claim 1, wherein the forming member is mounted in a fixed position relative to a portion of the stand.

7. A system as set forth in claim 1, wherein the stand includes a height-adjustment mechanism, the base of the stand includes a clamp, or the stand includes an angular adjustment mechanism.

8. A system as set forth in claim 1, wherein the transversely extending guide includes a portion that is rotatable about a longitudinal axis.

* * * * *